US007687017B2

(12) United States Patent
Thut

(10) Patent No.: US 7,687,017 B2
(45) **Date of Patent: *Mar. 30, 2010**

(54) MULTI FUNCTIONAL PUMP FOR PUMPING MOLTEN METAL

(76) Inventor: Bruno H. Thut, 16755 Park Circle Dr., Chagrin Falls, OH (US) 44023-4598

( * ) Notice: Subject to any disclaimer, the term of this patent is extended or adjusted under 35 U.S.C. 154(b) by 146 days.

This patent is subject to a terminal disclaimer.

(21) Appl. No.: 12/390,781

(22) Filed: Feb. 23, 2009

(65) Prior Publication Data

US 2009/0155042 A1 Jun. 18, 2009

Related U.S. Application Data

(60) Division of application No. 11/366,138, filed on Mar. 2, 2006, now Pat. No. 7,507,365, which is a continuation-in-part of application No. 11/348,635, filed on Feb. 7, 2006, now Pat. No. 7,497,988.

(60) Provisional application No. 60/659,356, filed on Mar. 7, 2005, provisional application No. 60/696,665, filed on Jul. 5, 2005.

(51) Int. Cl.
*F04D 27/00* (2006.01)

(52) U.S. Cl. ..... 266/45; 266/239

(58) Field of Classification Search ..... 266/239, 266/217, 603, 45

See application file for complete search history.

(56) References Cited

U.S. PATENT DOCUMENTS 1,865,918 A 7/1932 Junkers
2,472,412 A 6/1949 Fritz
2,808,782 A 10/1957 Thompson et al.
3,048,384 A 8/1962 Sweeney et al.
3,272,619 A 9/1966 Sweeney et al.
3,291,473 A 12/1966 Sweeney et al.
3,836,280 A 9/1974 Koch
3,984,234 A 10/1976 Claxton et al.
3,997,336 A 12/1976 van Linden et al.
4,128,415 A 12/1978 van Linden et al.
4,286,985 A 9/1981 van Linden et al.
4,322,245 A 3/1982 Claxton (Continued)

OTHER PUBLICATIONS

Messina, Joseph P., "Pump Handbook," Edited by Karassik, Igor J. et al., pp. 2.213-2.215.

(Continued)

*Primary Examiner*—Scott Kastler
(74) *Attorney, Agent, or Firm*—Pearne & Gordon LLP

(57) ABSTRACT

The present invention features a multi-functional pump for pumping molten metal, which includes a base that is submerged in molten metal having at least two impeller chambers. The base includes one or more inlet openings and one or more outlet openings. Each outlet opening leads from one of the impeller chambers. The invention enables the impeller to be moved to a position to rotate in either impeller chamber or while straddling impeller chambers. This enables the pump to have the versatility to operate in a circulation mode; a transfer mode; two or more circulation modes; two or more transfer modes; and a combination of transfer and circulation modes. The impeller chambers can be stacked over each other and the impeller can be moved vertically in and between impeller chambers. Also featured is a method of operating the multi-functional pump of the present invention.

7 Claims, 12 Drawing Sheets

U.S. PATENT DOCUMENTS

| | | | |
|---|---|---|---|
| 4,351,514 | A | 9/1982 | Koch |
| 4,426,068 | A | 1/1984 | Gimond et al. |
| 4,456,424 | A | 6/1984 | Araoka |
| 4,486,228 | A | 12/1984 | Ormesher |
| 4,491,474 | A | 1/1985 | Ormesher |
| 4,504,392 | A | 3/1985 | Groteke |
| 4,518,424 | A | 5/1985 | Ormesher |
| 4,743,428 | A | 5/1988 | McRae et al. |
| 4,786,230 | A | 11/1988 | Thut |
| 5,203,681 | A | 4/1993 | Cooper |
| 5,268,020 | A | 12/1993 | Claxton |
| 5,540,550 | A | 7/1996 | Kubota |
| 5,586,863 | A | 12/1996 | Gilbert et al. |
| 5,597,289 | A | 1/1997 | Thut |
| 5,622,481 | A | 4/1997 | Thut |
| 5,634,770 | A | 6/1997 | Gilbert et al. |
| 5,716,195 | A | 2/1998 | Thut |
| 5,785,494 | A | 7/1998 | Vild et al. |
| 5,842,832 | A | 12/1998 | Thut |
| 5,951,243 | A | 9/1999 | Cooper |
| 6,019,576 | A | 2/2000 | Thut |
| 6,152,691 | A | 11/2000 | Thut |
| 6,217,823 | B1 | 4/2001 | Vild et al. |
| 6,254,340 | B1 | 7/2001 | Vild et al. |
| 6,303,074 | B1 | 10/2001 | Cooper |
| 6,464,458 | B2 | 10/2002 | Vild et al. |
| 6,524,066 | B2 | 2/2003 | Thut |
| 6,533,535 | B2 | 3/2003 | Thut |
| 6,881,030 | B2 | 4/2005 | Thut |
| 7,476,357 | B2 * | 1/2009 | Thut ..... 266/239 |
| 2001/0028846 | A1 | 10/2001 | Vild et al. |
| 2006/0180963 | A1 | 8/2006 | Thut |

OTHER PUBLICATIONS

Three pages containing Figs. 1-4 from U.S. Patent No. 6,019,476 showing pump and impeller sold more than one year before the filing date.

"Bimba Position Feedback Cylinders," Brochure, pp. 7.5-6 (no date).

"Bimba Position Control System," Brochure, pp. 7.25, 7.26, 7.30 (no date).

"Elektrak 205," Brochure by Thomson, © 2003 Danaher Motion, pp. D-26, D-27, D-53, and D-54, Dec. 2003.

Schneider, R., "Working with Position-Feedback Cylinder Technology," http://www.bimba.com/techctr/schneidr.htm, printed May 24, 2005, reprinted from Hydraulics & Pneumatics, Sep. 1996.

* cited by examiner

MULTI FUNCTIONAL PUMP FOR PUMPING MOLTEN METAL

CROSS-REFERENCE TO RELATED APPLICATIONS

This application is a Divisional of U.S. application Ser. No. 11/366,138 filed on Mar. 2, 2006, and issued as U.S. Pat. No. 7,507,365 on Mar. 24, 2009 which claims the benefit of Provisional application Ser. No. 60/659,356, filed on Mar. 7, 2005, which is expired, and claims the benefit of Provisional application Ser. No. 60/696,665 filed on Jul. 5, 2005, which is expired. The Ser. No. 11/366,138 application is a Continuation-in-Part of Ser. No. 11/348,635 filed on Feb. 7, 2006, and issued as U.S. Pat. No. 7,497,988 on Mar. 3, 2009. These applications are incorporated in their entirety herein by reference.

FIELD OF THE INVENTION

The present invention relates to pumps for pumping molten metal, in particular, to pumps used for scrap submergence and die casting applications.

BACKGROUND OF THE INVENTION

Pumps for pumping molten metal are used in furnaces in the production of metal articles. Common functions of pumps are circulation of molten metal in the furnace or transfer of molten metal to remote locations along transfer conduits or risers that extend from a base of the pump to the remote location. The pump may be located in a separate, smaller chamber such as a pump well adjacent the main hearth.

Currently, many metal die casting facilities employ a main hearth containing most of the molten metal. Solid bars of metal may be periodically melted in the main hearth. Metal scrap such as from aluminum cans is often charged into the molten metal in a scrap well adjacent the main hearth. A transfer pump is located in a separate well adjacent the main hearth. The transfer pump draws molten metal from the well in which it resides and transfers it into a ladle from which the molten metal is taken to a holding furnace and fed into a plurality of die casters that form metal articles. Die casting furnaces employ only a transfer pump, not a circulation pump. When scrap metal is added, it lowers the temperature of the molten metal. Burners located above the molten metal in the main hearth must maintain molten metal temperature while compensating for the drop in temperature caused by scrap charging. A tremendous amount of fuel is required by the burners to heat and maintain the molten metal at a suitable temperature.

In view of the heat applied by the burners at the surface of the molten metal and the cold scrap added to the bath, temperature differences arise in the bath. For example, in a die casting furnace the temperature of molten aluminum might be 1550° F. near the surface of the bath, 1250° F. in a location where the scrap is charged, and 1350° F. near the bottom of the bath. Important considerations in a die casting facility include the consumption of fuel and cleanliness and physical properties of the cast metal articles. Aluminum oxide is formed on the surface of the molten metal as the molten aluminum oxidizes. Aluminum oxide has an affinity for hydrogen gas. It is undesirable to have hydrogen gas in the metal. As the cast metal solidifies it releases trapped hydrogen gas, forming pin holes in the metal articles. Higher temperatures of molten aluminum lead to increased absorption of hydrogen gas and increased pin hole defects with resulting compromise in the physical properties of the metal articles.

Various devices have been proposed for use in submerging metal scrap. One such device disclosed in U.S. Pat. No. 6,217,823 includes a ramp located in a charge well for creating a vortex that pulls scrap down into the molten metal. A drawback of this scrap submerging system is that all of the molten metal is required to be passed through the scrap well. This poses pumping inefficiencies during times when no scrap is being charged. In addition, this may lead to increased generation of oxides due to the greater surface area and turbulence involved in passing molten metal along a vortex all of the time.

DISCLOSURE OF THE INVENTION

The present invention features a multi-functional pump for pumping molten metal, which includes a base that is submerged in molten metal having at least two impeller chambers. The base includes one or more inlet openings and one or more outlet openings. Each outlet opening leads from one of the impeller chambers. The invention enables the impeller to be moved to a position to rotate in either impeller chamber or while straddling impeller chambers. This enables the pump to have the versatility to operate in a circulation mode; a transfer mode; two or more circulation modes; two or more transfer modes; and a combination of transfer and circulation modes. The impeller chambers can be stacked over each other and the impeller can be moved vertically in and between impeller chambers. Inventive vaned or barrel type impellers can be used to facilitate pumping while straddling impeller chambers, in view of an elongated bearing member on the impeller that maintains position relative to a bearing ring attached to the base or an inlet protector sleeve. The multifunctional pump of the invention enables infinite adjustment of the impeller using a programmable logic controller that results in positioning of the impeller at any of various locations in the base to achieve any desired output. The inventive pump is ideally suited for use in die casting and scrap submergence applications. Also featured is a method of operating the multifunctional pump of the present invention.

More specifically, the inventive multifunctional pump for pumping molten metal includes a base having two, three or more impeller chambers. An impeller is connected to a lower end portion of a shaft. An upper end portion of the shaft is coupled to a drive shaft of a motor, which rotates the impeller in the impeller chambers. The base is submerged in molten metal and includes one or more inlet openings and outlet openings. In a particular design, each outlet opening includes a discharge passageway extending from one of the impeller chambers toward an exterior surface of the base. The pump can operate in a circulation mode using an impeller chamber and discharge passageway adapted to circulate molten metal; a transfer mode using an impeller chamber, discharge passageway and outlet conduit adapted to transfer molten metal; two or more circulation modes; two or more transfer modes; and a combination of transfer and circulation modes. The transfer impeller chamber and the circulation impeller chamber are located at different positions of the base. In particular, the impeller chambers are stacked over each other relative to a rotational axis of the shaft. In one aspect, one or more of the impeller chambers are nonvolute chambers as disclosed in U.S. Pat. No. 5,203,681. Alternatively, advantages are achieved when constructing and arranging the base so as to include volutes in one or more of the impeller chambers.

In the pump design for the transfer mode, the pump includes a socket in the base for receiving an outlet conduit.

The socket is in fluid communication with the discharge passageway that extends from the transfer impeller chamber. In the pump design for the circulation mode, the discharge passageway extends from a circulation impeller chamber to a discharge opening formed in an exterior surface of the base. The discharge opening may be open to the molten metal bath or connected to an adapter conduit, for carrying out circulation.

The present invention permits an impeller mounted to the end of the shaft to be moved between selected impeller chambers. In particular, the impeller is moved vertically between stacked impeller chambers along a rotational axis of the shaft and impeller. The impeller can maximize molten metal discharge into one discharge passageway with which it is aligned and can minimize molten metal discharge into another discharge passageway with which it is not aligned. In transfer mode, the shaft is moved vertically to position the impeller in the selected transfer impeller chamber where it is rotated. This causes molten metal to be directed into a base inlet opening, into the transfer impeller chamber, through the discharge passageway, and through the outlet conduit to an intended location. In circulation mode, the shaft is moved vertically to position the impeller in the selected circulation impeller chamber where it is rotated. This causes molten metal to be directed into a base inlet opening, into the circulation impeller chamber, through the discharge passageway and to a location exterior of the base.

In a second embodiment, the impeller is able to be positioned in a single impeller chamber and/or in a straddle position where the impeller is positioned in adjacent impeller chambers simultaneously (e.g., impeller outlet openings are in fluid communication with two discharge passageways). When the impeller is rotated in a single impeller chamber the pump can function to achieve either transfer or circulation output. When the impeller is rotated in the straddle position the pump can achieve a blended output (e.g., simultaneous transfer and circulation output). In the straddle position, the impeller can be moved to a plurality of positions between full up and full down strokes in adjacent impeller chambers, so as to selectively release molten metal into the first and second discharge passageways, by amounts that vary according to the relative areas of the impeller outlet openings that are exposed to the two discharge passageways. For example, if an operator desires to direct most of the output of the pump to transfer but desires continuous circulation, he can position the impeller such that most of the area of the impeller outlet openings is exposed to the transfer discharge passageway while a smaller area of the impeller outlet openings is exposed to the circulation discharge passageway. This blend of transfer and circulation can be changed, for example, when transfer at a lesser flow rate is desired, by adjusting the position of the impeller so as to lessen the area of the impeller outlet openings that are exposed to the transfer discharge passageway and to increase the area of the impeller outlet openings that are exposed to the circulation discharge passageway. Conversely, when mostly circulation and a small amount of transfer is initially desired, the pump can be operated so as to rotate the impeller such that the area of the impeller outlet openings is mostly exposed to the circulation discharge passageway, with a lesser area of the impeller outlet openings being exposed to the transfer discharge passageway. When more transfer is desired, the impeller can be moved to expose more of the area of the impeller outlet openings to the transfer discharge passageway. In addition, when the impeller outputs only into a single discharge passageway, the function of the pump is either transfer or circulation.

The shaft and impeller can be moved vertically by a manual, hydraulic, pneumatic, screw-type or other actuator device. The inventive pump has the ability to move the impeller in a few or several select positions or it may facilitate what is referred to herein as "infinite adjustment" wherein a programmable logic controller ("PLC") sends signals to the actuator instructing movement of the impeller to one of a plurality of position increments. A component of the impeller positioning device (e.g., a PLC) may also receive feedback signals informing it of the position of a component of the actuator, and thus the impeller or shaft position, at any point in time.

Reference herein to "infinite" control of the position of the impeller in impeller chambers of the pump, means positioning the impeller at a selected one of a plurality of incremental positions in a first impeller position located in one impeller chamber in alignment with only its discharge passageway ("full output"), a second impeller position located in an adjacent impeller chamber in alignment with only its discharge passageway ("full output"), and in positions between the first and second positions. The term "infinite" is used herein to connote a plurality of positions to which the impeller can be moved vertically in the base, and should not be used to restrict the present invention. This does not require the existence of a limitless number of position increments nor does it require using all available positions or moving the impeller in only small increments.

For example, the PLC of the infinite impeller positioning means may be programmed to move the impeller to any of five commonly used positions in a pump including stacked circulation and transfer impeller chambers and respective discharge passageways: 1) full output into the transfer discharge passageway; 2) full output into the circulation discharge passageway, 3) straddling both discharge passageways for equal output into each; 4) straddling the discharge passageways with a majority of the area of the impeller outlets positioned to output into the transfer discharge passageway, and 5) straddling the discharge passageways with a majority of the area of the impeller outlets positioned to output into the circulation discharge passageway. This would enable operation of the pump in die casting or scrap charging applications, for example, to circulate-only or to transfer-only, at the maximum rate that pumps can commonly achieve. In addition, the pump can simultaneously transfer and circulate molten metal, wherein the discharge is carried out: at equal transfer and circulation flow rates; at a higher transfer flow rate and lower circulation flow rate; or at a lower transfer flow rate and higher circulation flow rate. Those of ordinary skill in the art will appreciate in view of this disclosure that the infinite impeller positioning apparatus enables a wide variety of possible flow rates and different modes of functionality within the scope of the present invention. Many other positions of the impeller are possible in accordance with the present invention.

Many variations to the present invention are possible, which fall within its spirit and scope. For example, the impeller may include only an upper inlet opening with the lower end portion being an imperforate circular end face (upper intake), or only a lower inlet opening with the upper end portion being an imperforate circular end face (lower intake). One such suitable impeller is a PENTELLER® brand impeller with imperforate base, a squirrel-cage type impeller, barrel type impeller, or the like. Using an upper intake PENTELLER® brand impeller, the base is constructed with the only inlet opening being disposed in an upper portion of the base. Molten metal enters the upper inlet opening and travels to the upper impeller chamber when the impeller rotates there. When the impeller is rotated in the lower impeller chamber, molten metal enters the upper inlet opening, passes through the upper impeller chamber and travels to the lower impeller chamber. The reverse is also possible: using a base in which the only inlet opening is located at the lower portion of the base. In both cases, a single intake impeller can be used, having an impeller inlet near only one end portion and impeller outlets near a side of the impeller.

The top feed pump design employs an impeller having at least one upper inlet opening and the bottom feed pump design employs an impeller having at least one bottom inlet opening. Even though this top or bottom feed pump design has only an upper or lower inlet opening into the base, the base may be constructed to include concentric upper and lower openings relative to the rotational axis. This will enable the type of single intake impeller (top or bottom intake) or dual intake impeller, to determine whether the pump operates as a top feed, bottom feed, or top-and-bottom feed pump.

The base can be designed with top and bottom inlet openings. In this case, a dual intake impeller having the ability to draw molten metal from the top and bottom base inlet openings may be used. However, an upper impeller having only a top intake and a separate lower impeller having only a bottom intake could also be mounted to the same shaft. A dual-intake impeller such as a baffle impeller having a baffle that prevents fluid communication between upper and lower passages in the impeller, may be used in a pump base having upper and lower inlet openings. A suitable baffle impeller is disclosed in the U.S. patent application Ser. No. 11/348,635 filed Feb. 7, 2006, entitled "Vortexer Apparatus", which is incorporated herein by reference in its entirety (hereinafter "Vortexer Application"). Other variations include the number and location of base inlets and outlets, number of impeller chambers, number, position, size and type of discharge passages and transfer piping and the number, type and location of impellers or impeller members that are employed. The impeller outlet openings can traverse various heights and extents of the circumference of the impeller and can have various shapes and sizes. Reference herein to "impeller member" means a portion of a single impeller or one of two or more separate impellers on the same shaft, which can move molten metal when rotated.

The multifunctional pump can include three stacked impeller chambers. For example, the pump can include an upper, first transfer impeller chamber, a middle circulation impeller chamber and a lower, second transfer impeller chamber. The molten metal is transferred to different locations by positioning the outlet conduits so as to discharge at different locations. One of the upper transfer, middle circulation or lower transfer, impeller chambers may be selected for discharge by vertically moving the shaft effective to place the impeller in the desired impeller chamber. Moreover, the impeller can achieve a blend of first transfer and circulation or a blend of second transfer and circulation, by positioning the impeller so as to straddle the upper and middle impeller chambers or the middle and lower impeller chambers, respectively.

The three chamber pump may use a baffle, dual intake impeller of the type disclosed in the Vortexer Application. This impeller includes two sets of impeller outlets: one set of impeller outlets communicates only with upper impeller inlet openings while the other set of impeller outlets communicates only with lower impeller inlet openings. This presents many possible variations in function of the pump depending on the design of the impeller chambers and impeller. For example, an upper impeller member of the baffle impeller may rotate in the upper transfer impeller chamber while a lower impeller member of the baffle impeller rotates in the middle circulation impeller chamber for effecting simultaneous first transfer and circulation. The baffle impeller may be moved downward so that the upper impeller member is located in the middle circulation impeller chamber and the lower impeller member is located in the lower transfer impeller chamber. This would effect simultaneous flow of molten metal to the second transfer location and circulation of molten metal.

It may also be possible to operate the three chamber pump using the baffle impeller in the straddle position to achieve blended flow. When the impeller straddles impeller chambers, the impeller may be lowered such that the impeller outlet openings of the upper impeller member are exposed to the upper discharge passageway while the impeller outlet openings of the lower impeller member are exposed to the lower discharge passageway. Depending on the vertical spacing between the impeller outlets, height of the baffle and vertical spacing between impeller chambers, this position of the baffle impeller might achieve simultaneous transfer to the first and second transfer locations, with or without concurrent circulation. For example, with impeller outlets that have a smaller height than the height of the discharge passages, the impeller outlets might only discharge into the upper and lower discharge passageways and may be blocked by walls sandwiching the middle impeller chamber, preventing circulation. A baffle impeller having impeller outlets with a greater height (or a base having thinner walls sandwiching the middle impeller chamber) might also discharge into the circulation discharge passageway when in this straddle position.

In another aspect, the baffle impeller might be designed so as to achieve upper or lower transfer, with or without circulation. Using an impeller having impeller outlets that are smaller than the height of the discharge passageways, the impeller may be positioned so as to discharge, for example, into the lower transfer passageway as well as into the circulation passageway, when the impeller is located just above the full down position. This pump might also achieve transfer only. Further movement of the impeller downward may put the impeller outlet openings in a position where they are either blocked by the separating wall of the base (such as when positioned in alignment with the wall between the lower and middle impeller chambers) and/or located in the lower impeller chamber, which effects discharge only in the lower discharge passageways. This operation could be reversed for the upper impeller chamber. The impeller chambers or discharge passageways can have different overall heights or different heights than one another, providing the wall between impeller chambers with different heights and varying the spacing and size of the impeller inlet and outlet openings. For example, the upper and lower discharge passageways might have a smaller height than the middle discharge passageway. The upper inlet or outlet impeller openings might have a different size than the lower inlet or outlet impeller openings.

One application of the inventive pump is die casting. Rather than employing a conventional transfer-only pump in the die casting furnace, the present invention features the inventive multifunctional pump in a die casting furnace. The inventive pump is able to achieve transfer, circulation, or both transfer and circulation simultaneously. Thus, during periods when no transfer is required, the pump can circulate only and stop transferring molten metal, by moving the impeller so that it only has impeller outlet openings exposed to the circulation impeller chamber (full circulation output). The inventive pump can also simultaneously circulate the molten metal while molten metal transfer takes place. This is believed to provide a number of advantages especially compared to die casting furnaces that employ only a transfer pump. By continuously or periodically circulating the molten metal, the molten metal bath of the die casting furnace may become more homogeneous and temperature gradients therein might be avoided. Circulation is expected to mix the hot molten metal at the surface of the furnace with the cooler molten metal at the furnace bottom and near the scrap. In the example of the die casting furnace, most of the circulated molten metal bath may have a temperature of, for example, 1400° F. and the burners are expected to require less fuel oil to generate the heat (e.g., 1450° F. rather than 1550° F.) needed to maintain this temperature. This could result in a tremendous fuel savings to producers of die cast metal articles. Moreover, because most of the molten metal bath is maintained at a lower temperature by virtue of the circulation of the molten metal, there might be less hydrogen gas absorption in the molten metal. This may result in fewer pinhole defects in the cast metal articles.

Another application in which the multifunctional pump of the present invention is suitable, is in connection with scrap submergence. Instead of the inefficient and less clean method of passing all molten metal along a vortex in a scrap charging chamber, the inventive multifunctional pump is able to conduct either circulation or transfer into a vortex chamber such as that described in the Vortexer Application, which is incorporated by reference. Moreover, the present invention is able to achieve simultaneous circulation and transfer into the scrap charging chamber. Therefore, a blend of transferred and circulated molten metal can be output from the pump and changed to achieve a desired amount of molten metal that is circulated and a desired amount of molten metal that travels to the scrap charging chamber. The present invention enables not only blended molten metal output, but can also stop molten metal flow to the vortex vessel entirely during periods when no scrap is being charged into the molten metal. This advantageously avoids the greater oxidation that occurs using the device of the U.S. Pat. No. 6,217,823 when all of the molten metal of the furnace is passed through the vortex vessel. As a result, the molten metal of the present invention is expected to be more homogeneous, cleaner and able to produce metal articles more economically and with fewer defects.

The pump may include an apparatus for injecting gas near an inlet opening of the base, inside one or more of the impeller chambers, or near a discharge passageway. This may be achieved as described by U.S. Ser. No. 11/292,988 filed Dec. 2, 2005, entitled "Gas Mixing and Dispersement in Pumps for Pumping Molten Metal", which is incorporated herein by reference in its entirety. Suitable gases or additives include inert gases (e.g., argon or nitrogen), reactive gases (e.g., chlorine containing gas) or solid particles alone or entrained in gas. The gas could be used to treat the molten metal or to purge one or more of the impeller chambers for periodic cleaning or enhanced operation.

Many additional features, advantages and a fuller understanding of the invention will be had from the accompanying drawings and the detailed description that follows. It should be understood that the above Disclosure of the Invention describes the invention in broad terms while the following Detailed Description describes the invention more narrowly and presents embodiments that should not be construed as necessary limitations of the broad invention as defined in the claims.

DETAILED DESCRIPTION

Figure 3:
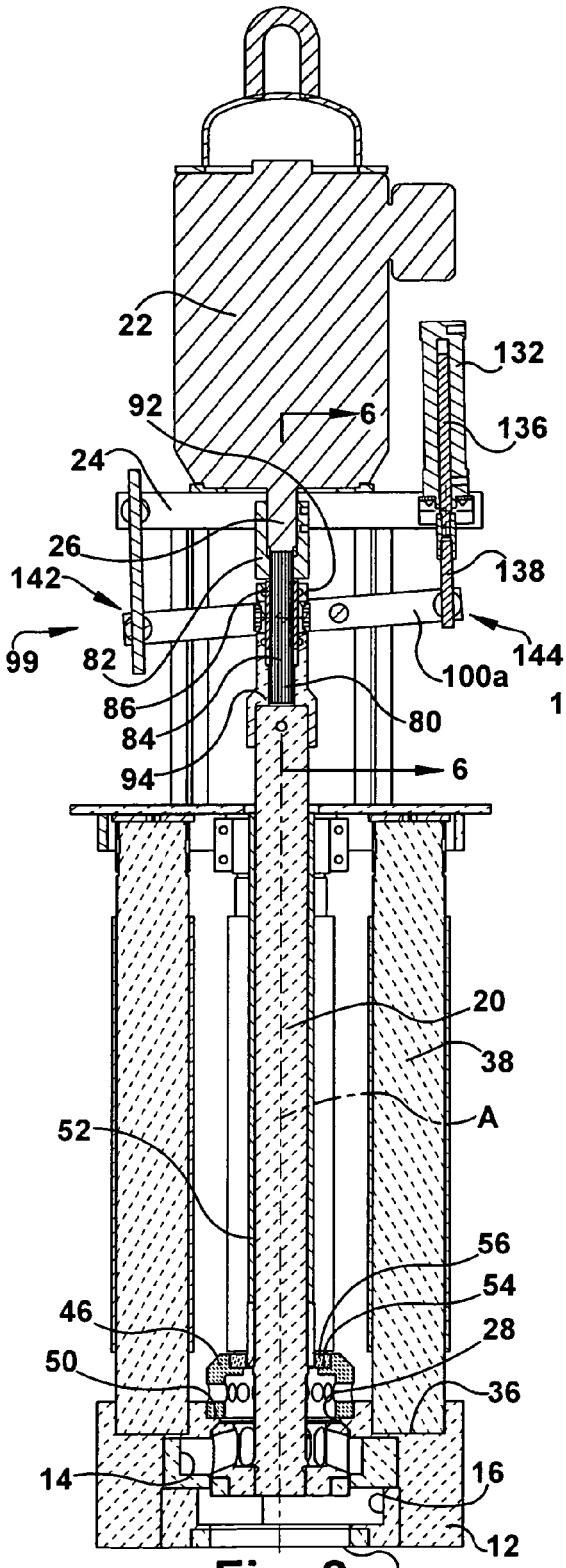
FIGS. 3 and 4 are vertical cross-sectional views showing the impeller positioned in the upper and lower impeller chambers of a base of the pump, respectively.
Figure 4:
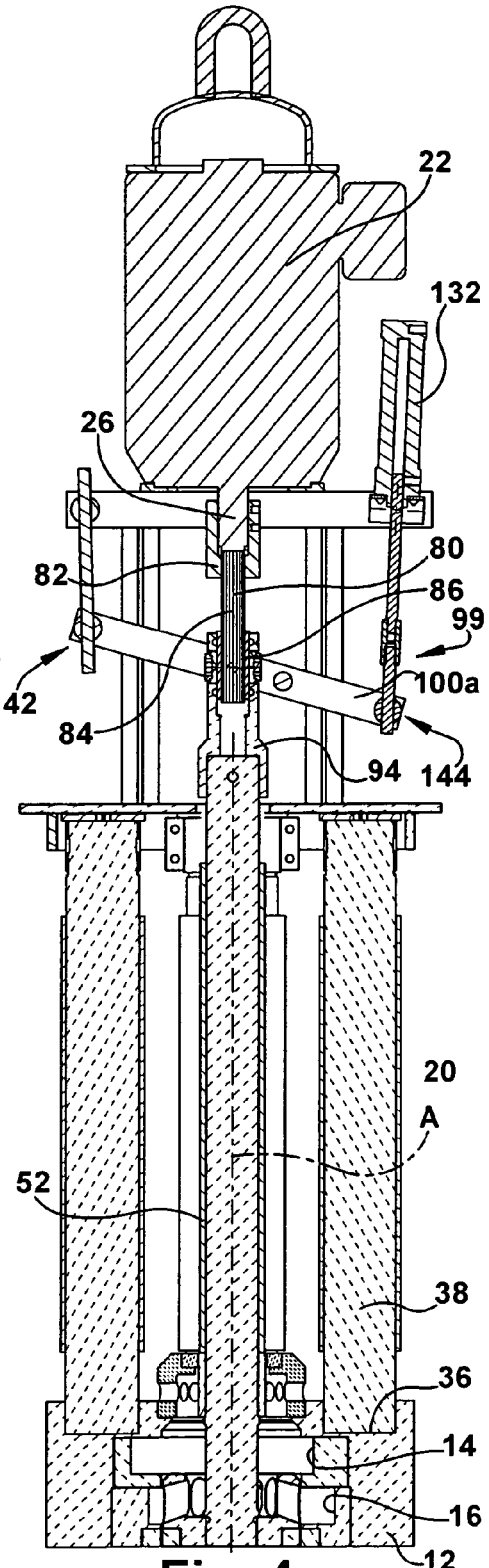
Figure 9:
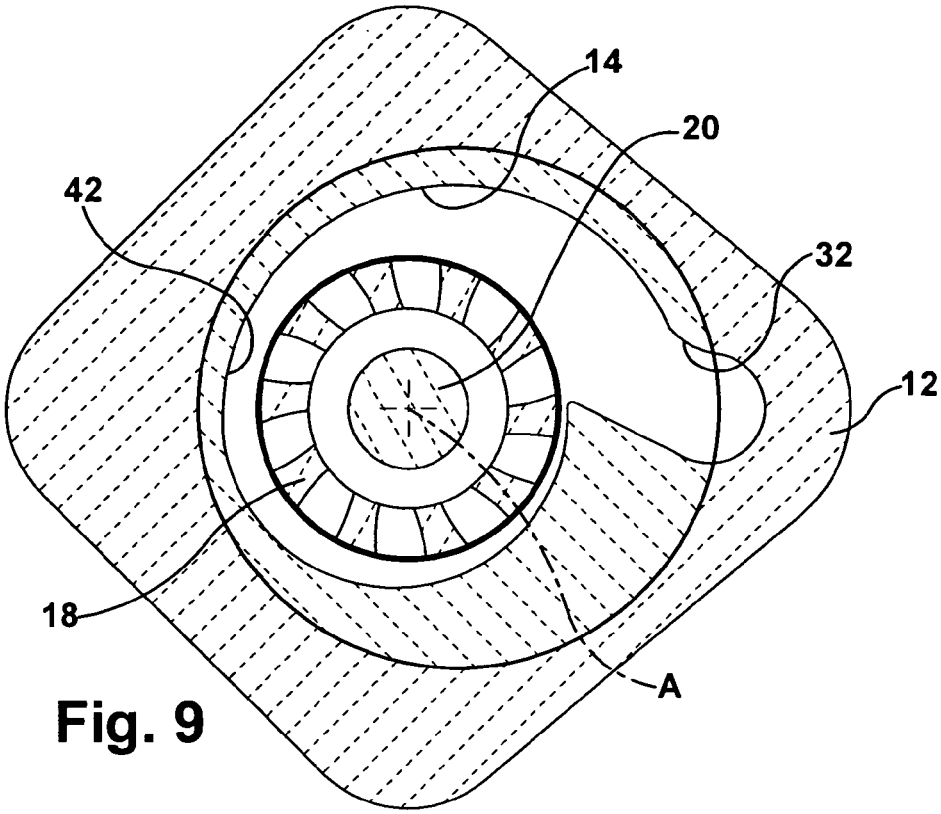
FIG. 9 is a cross-sectional view of the upper impeller chamber taken along the cutting plane designated by lines and arrows labeled 9-9 in FIG. 7.
Figure 10:
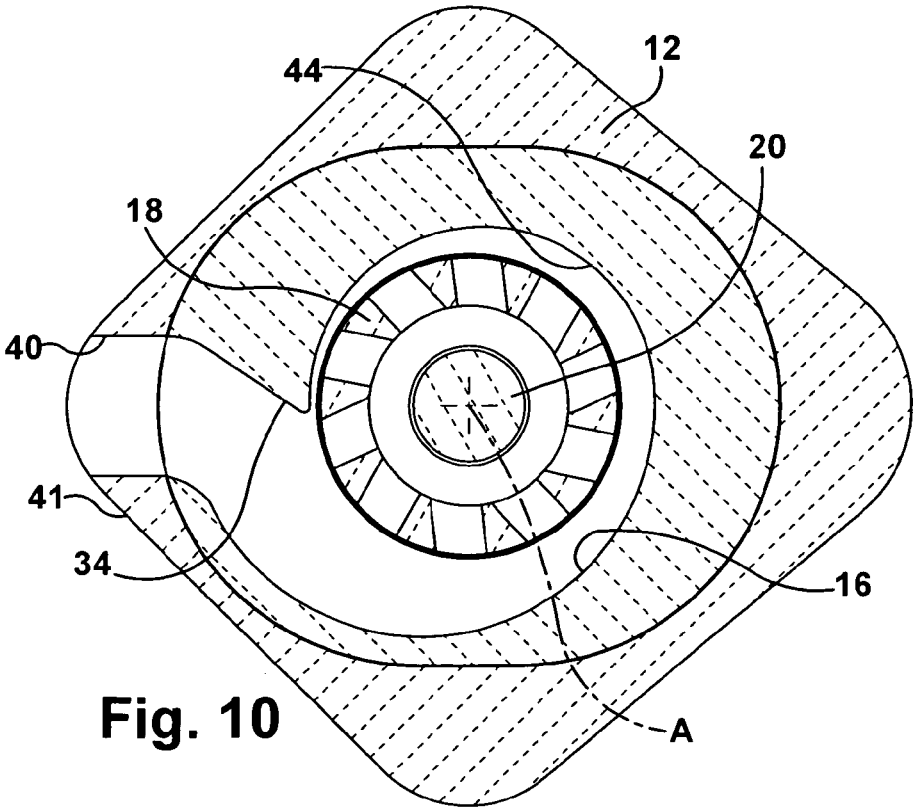
FIG. 10 is a cross-sectional view of the lower impeller chamber taken along the cutting plane designated by lines and arrows labeled 10-10 in FIG. 8.

Referring now to the drawings, a first embodiment of the present invention features a pump 10 including a base 12 adapted to be submerged in molten metal and including an upper transfer impeller chamber 14 stacked or disposed over a lower circulation impeller chamber 16. An impeller 18 is connected to a lower end portion of a pump shaft 20. A motor 22 is supported above the molten metal on a motor mount 24. The motor mount 24 can have various configurations and in this particular design includes a base plate 24*a* having an opening 21 for accommodating the shaft and may include an opening 23 for accommodating a riser. The motor mount also includes brackets 24*b* for supporting the motor 22 above the base plate 24*a*. The upper end portion of the shaft is coupled by coupling 25 to the drive shaft 26 of the motor, which rotates the impeller in a selected impeller chamber. The base includes upper and lower circular openings 28, 30 that are concentric to each other around the axis of rotation A of the impeller and shaft (FIGS. 3 and 4). The base includes two outlet passageways enabling molten metal to leave the base. A transfer discharge passageway 32 extends from the upper transfer impeller chamber 14 to a socket 36 (FIG. 9). A lower end of a riser 38 is cemented in the socket 36 and the upper end of the riser extends toward a discharge location. The upper end of this riser is mounted to the motor mount plate 24*a*, and is joined by an elbow (not shown) to another conduit that extends to the desired discharge location. A circulation discharge passageway 34 (FIG. 10) extends from the circulation impeller chamber 16 to a discharge opening 40 formed in the exterior surface 41 of the base 12. The transfer and circulation impeller chambers both have walls that form volutes 42, 44, respectively, in this exemplary design (FIGS. 9 and 10). The volutes enable the pump to pump molten metal more efficiently compared to pumps in which the impeller is located in a nonvolute impeller chamber.

Figure 1:
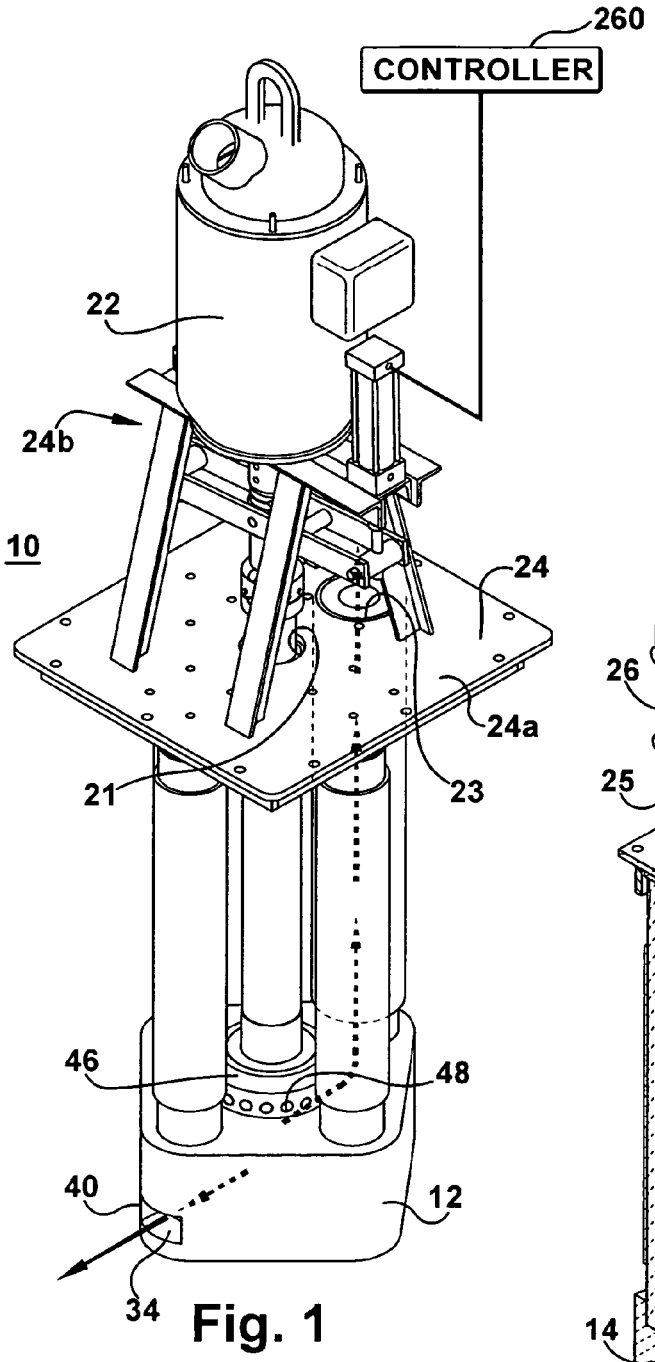
FIG. 1 is a perspective view of one embodiment of a pump constructed in accordance with the present invention.
Figure 7:
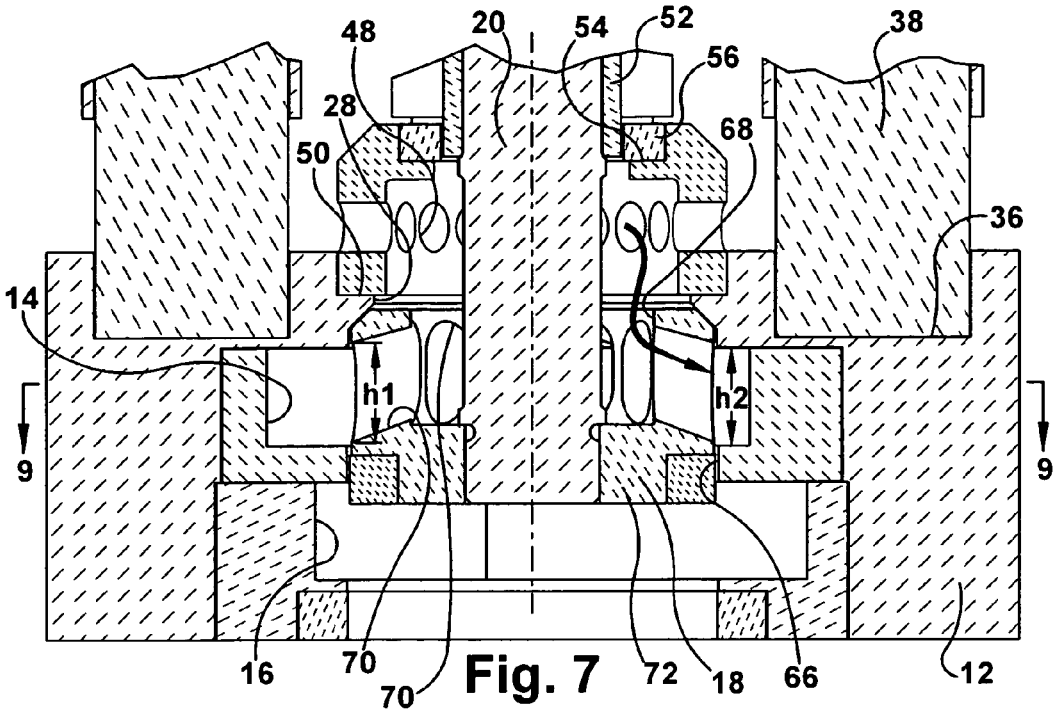
FIGS. 7 and 8 are enlarged vertical cross-sectional views showing the impeller positioned in the upper and lower impeller chambers of a base of the pump, respectively.
Figure 8:
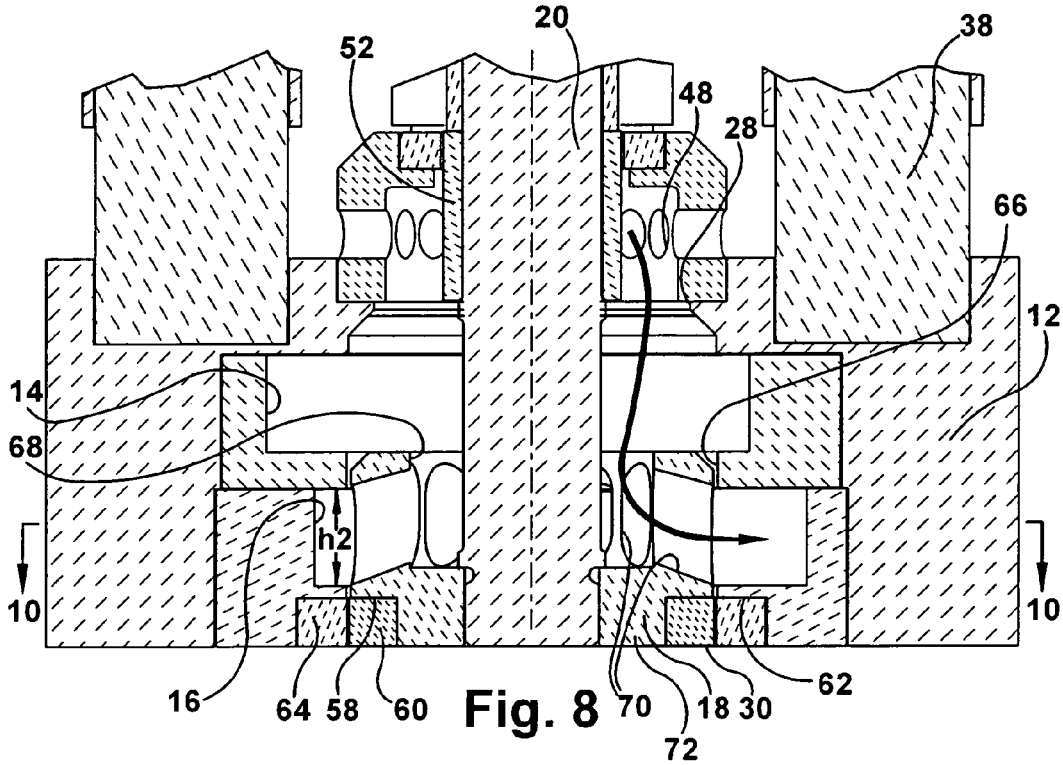

This particular pump design includes an inlet protector 46 (FIG. 1) such as disclosed in U.S. Pat. No. 6,533,535 by the inventor, which is incorporated herein by reference in its entirety. The inlet protector is in the form of a shaft sleeve having a plurality of openings 48 of a predetermined size effective to prevent material of greater size from entering the base. The inlet protector 46 is cemented onto a shoulder 50 around the upper opening 28 of the base (FIG. 3). The shaft includes a bearing sleeve 52. The inlet protector includes a shoulder 54 onto which a bearing ring 56 is cemented. All bearing rings discussed in this disclosure are composed of silicon carbide or other suitable wear-resistant refractory material known to those of ordinary skill in the art. As shown in FIGS. 7 and 8, the shaft bearing sleeve 52 is elongated so that its exterior surface is able to engage the inlet protector bearing ring 56 throughout the entire vertical travel of the shaft along the rotational axis, between a position inside the transfer impeller chamber (FIG. 7) and a position inside the circulation impeller chamber (FIG. 8).

The impeller includes a shoulder 58 at a lower end portion on which a bearing ring 60 is cemented. The lower surface of the base around the lower opening 30 includes a shoulder 62 in which a base bearing ring 64 is cemented (FIG. 8). Another optional bearing ring (not shown) may be fastened higher in the base so as to engage the impeller bearing ring when the impeller is inside the upper impeller chamber, such as at a wall 66 between impeller chambers. However, the shaft bearing surface and bearing surface on the inlet protector, along with the impeller and base bearings, are expected to be sufficient for protecting the shaft and impeller from damage in both the upper and lower impeller positions.

Any suitable impeller may be used in this embodiment of the present invention including the squirrel cage impeller shown in the figures, vaned type and barrel type, single or dual intake, and baffle or not between impeller members. Examples of impellers that are suitable for use in the present invention are disclosed in U.S. Pat. No. 6,881,030, which is incorporated herein by reference in its entirety.

Figure 2:
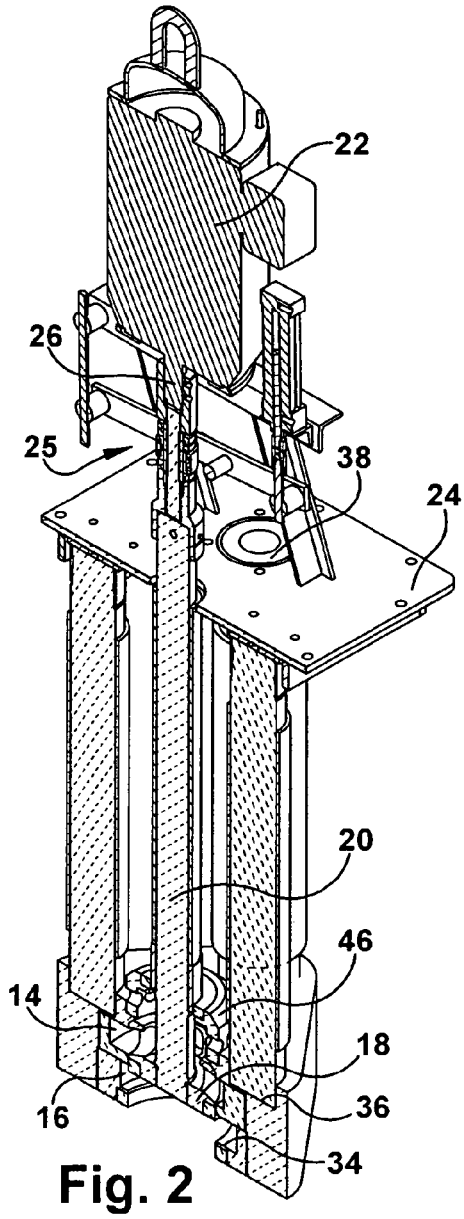
FIG. 2 is a perspective cross-sectional view of the pump of FIG. 1 wherein the impeller is located in an upper impeller chamber of a base of the pump.

The impeller is advantageously able to be vertically moved up or down to either selected impeller chamber. This can maximize the flow of molten metal from the impeller chamber in which the impeller is rotated and can minimize molten metal flow from the other impeller chamber in which the impeller is not rotated. In transfer mode (FIGS. 2, 3 and 7), the shaft 20 is moved vertically along the rotational axis to position the impeller in the selected upper transfer impeller chamber 14. This causes molten metal to be directed through the inlet protector openings 48, into the base inlet opening 28, into an inlet opening 68 of the impeller, into the transfer impeller chamber 14 and out the outlet openings 70 of the impeller (see the arrows in FIG. 7 representing molten metal flow), through the transfer discharge passageway 32 to the socket 36, and along the passageway in the riser 38 to a desired discharge location.

In circulation mode (FIGS. 4 and 8), the shaft 20 is moved vertically along the rotational axis to position the impeller 18 in the lower circulation impeller chamber 16. This causes molten metal to be directed through the openings 48 of the inlet protector, into the base inlet opening 28, past the transfer impeller chamber 14, into the impeller inlet opening 68, into the circulation impeller chamber 16, out the impeller outlet openings 70, through the circulation discharge passageway 34, through the discharge opening 40 and to a discharge location outside the base (see the arrows in FIG. 8 representing molten metal flow).

The impeller outlet openings 70 can have a height h1 that is approximately the same height h2 as the transfer discharge passageway and the circulation discharge passageway (FIGS. 7 and 8). When the impeller is positioned in the transfer impeller chamber or in the circulation impeller chamber, its outlet openings are aligned with and approximately the same height h1 as the height h2 of the transfer or circulation discharge passageways (see FIGS. 7 and 8). Thus, rotation of the impeller directs most or all of the molten metal into the outlet passageway with which it is aligned (full output) and minimizes molten metal flow from the other outlet passageway in which it is not aligned. If a single intake impeller with an imperforate base plate is used, such as the conventional squirrel cage impeller having imperforate base 72 shown in FIGS. 7 and 8, rotation of the impeller in the upper transfer impeller chamber will inhibit molten metal flow out the lower circulation impeller chamber. While the impeller is in the upper chamber, the imperforate base 72 of the impeller will block molten metal from traveling from the upper base inlet and upper impeller chamber into the lower impeller chamber. While rotation of the squirrel cage impeller in the lower circulation impeller chamber will maximize molten metal flow from that chamber, it is possible that rotation of the impeller in the lower chamber may cause some molten metal to travel into the transfer discharge passageway or into the riser. In this case the riser may include a bleed hole to relieve a possible rise in molten inside the riser.

The pump shown in FIGS. 1-10 is advantageously suitable for use in die casting. This pump enables the operator to transfer molten metal to a ladle when desired. To perform this function, the impeller 18 is moved into the upper transfer impeller chamber 14 and rotated there (FIG. 7). Alternatively, at times when molten metal does not need to be transferred to the ladle, the pump can operate in circulation mode. To perform this function, the impeller 18 is moved into the lower circulation impeller chamber 16 and rotated there (FIG. 8). When the impeller is rotated in the circulation impeller chamber, the multifunctional pump will only circulate molten metal. This provides all of the advantages discussed earlier including a more homogeneous, lower temperature bath and reduced fuel requirements for the burners of the main hearth.

Referring to FIGS. 2-6, one design of a suitable mechanism for moving the shaft and impeller includes the coupling 25 between the pump shaft 20 and the drive shaft 26, which includes a spline shaft 80 having upper and lower ends. The upper end of the spline shaft is fixed to the motor drive shaft 26 by a motor coupling 82. The spline shaft 80 is integrally formed with or fastened to the coupling 82. The spline shaft includes vertically extending splines 84 around its periphery. The spline shaft engages a spline sleeve 86. The spline sleeve 86 has a plurality of vertically extending splines 88 around a central opening 90, which engage the splines 84 of the spline shaft. This spline engagement permits vertical movement of the spline sleeve relative to the spline shaft. Rotation of the drive shaft 26 and engaged spline shaft 80 will rotate the spline sleeve 86 at the various vertical positions the spline sleeve 86 occupies relative to the spline shaft 80. Fixedly fastened onto an outer surface of the spline sleeve is a collar 92 and a pump shaft coupling 94. The upper end portion of the pump shaft 20 is fixedly mounted to the pump shaft coupling 94. The connection between the pump shaft 20 and its coupling 94 may utilize a shear pin 96 as is known in the art. The drive shaft 26, spline shaft 80, spline shaft sleeve 86, spline shaft collar 92, pump shaft coupling 94 and pump shaft 20, all rotate together. The spline shaft does not support the weight of the pump shaft and impeller.

Figure 5A:
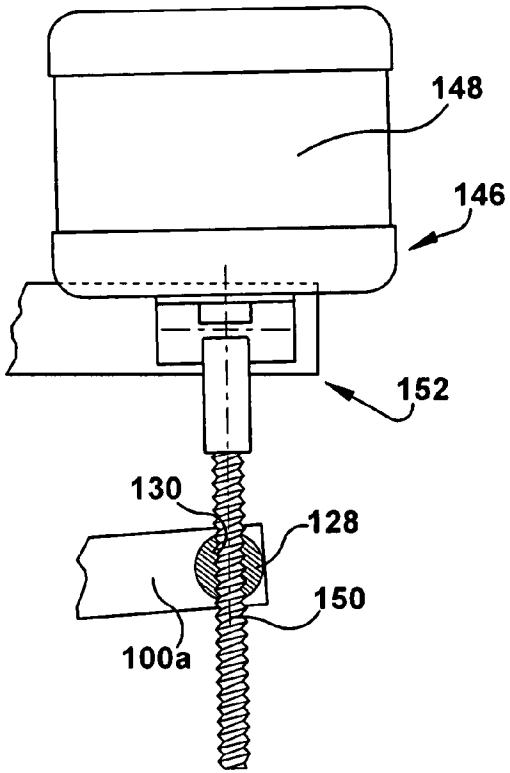
FIG. 5A is a front elevational view of another device for vertically moving the pump shaft in accordance with the present invention.
Figure 5:
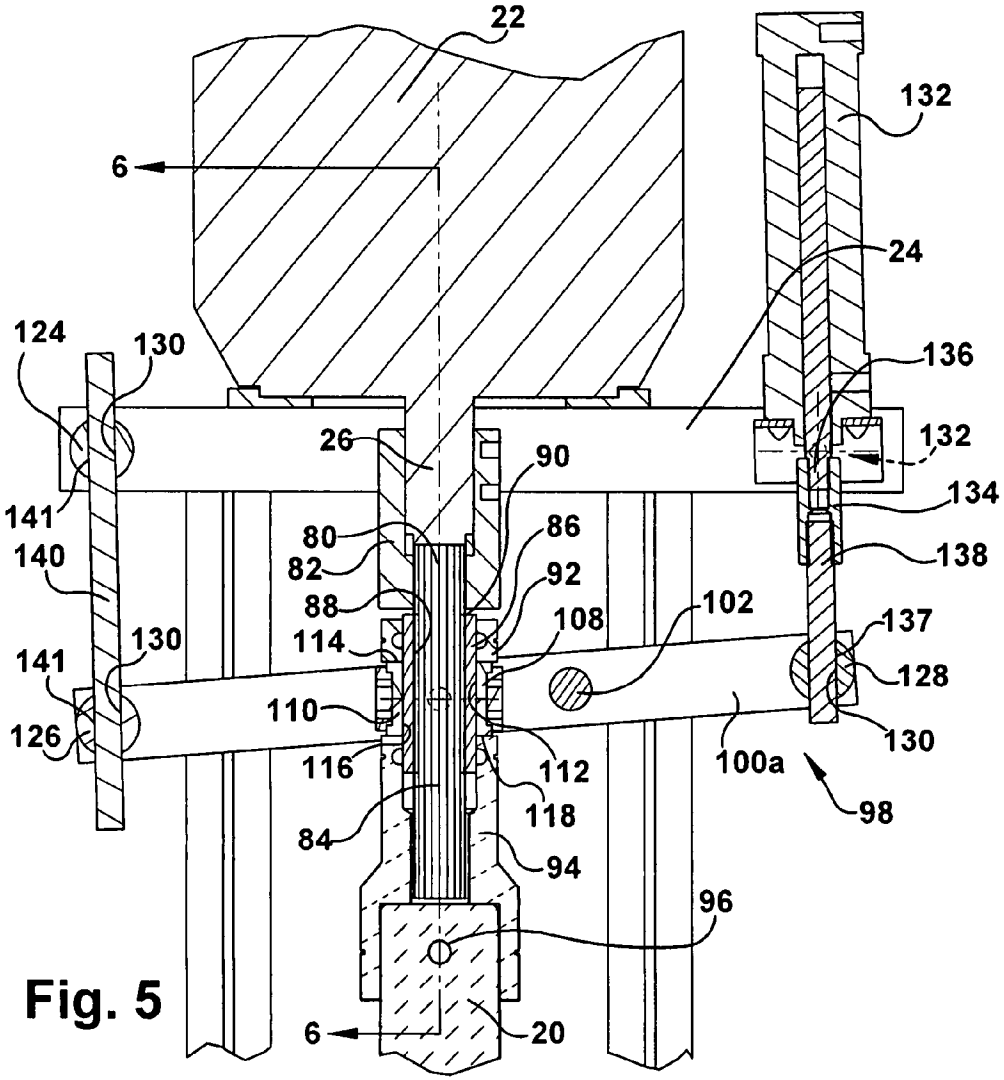
FIG. 5 is a vertical cross-sectional view showing a device for vertically moving the pump shaft in accordance with the present invention.
Figure 6:
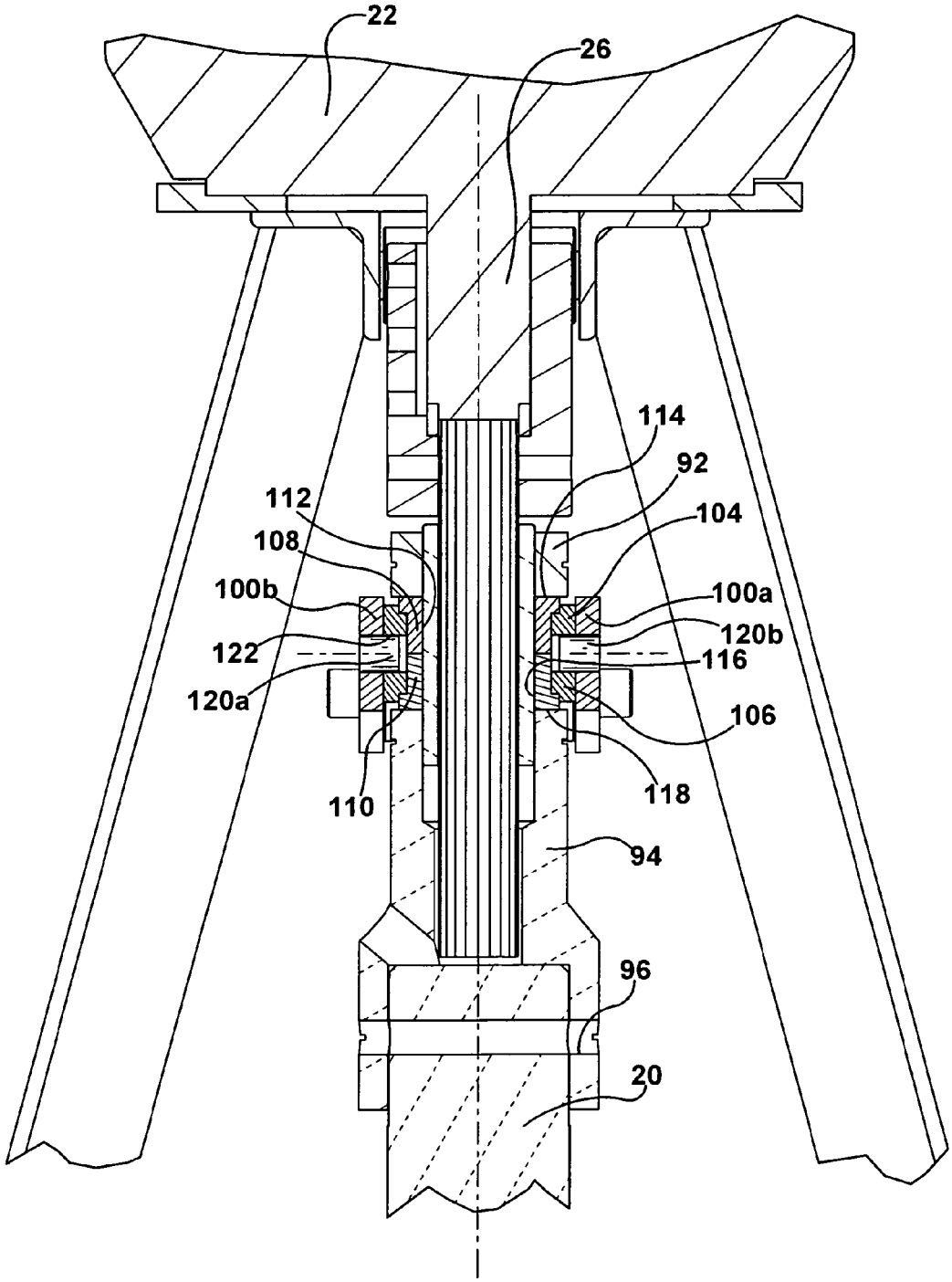
FIG. 6 is a cross-sectional view taken along the cutting plane designated by lines and arrows labeled 6-6 in FIG. 5, which is rotated 90 degrees relative to FIG. 5.

The mechanism for moving the shaft and impeller up and down, or impeller positioning device 99, also includes a lever arm assembly 98 including parallel arms 100*a*, 100*b* spaced by member 102 (FIGS. 5 and 6). Upper and lower retainer rings 104, 106 (FIG. 6) are in a position fixed around the spline sleeve. Upper and lower bearing rings 108, 110 are disposed around and against the spline sleeve. The upper retainer ring 104 fixes the upper bearing ring against the collar 92 and the lower retainer ring 106 fixes the lower bearing ring 110 against the shaft coupling 94. The upper bearing ring 108 has an inner, radial bearing component 112 that engages the rotating spline shaft and an upper thrust bearing component 114 that engages the rotating collar 92. The lower bearing ring 110 has an inner, radial bearing component 116 that engages the rotating spline shaft and a lower thrust bearing component 118 that engages the rotating pump shaft coupling 94. Stationary pins 120*a*, 120*b* (FIG. 6) extend inwardly from each arm within a space 122 between the stationary retainer rings 104, 106. A pivot member 124 has outwardly extending bosses received in openings in the motor mount 24 (FIG. 5). Another pivot member 126 has outwardly extending bosses received in openings at one end of the linkage arms. A pivot member 128 has outwardly extending bosses received in openings at the other end of the linkage arms. Each of the pivot members 124, 126, 128 has a central internally threaded hole 130.

A hydraulic or pneumatic cylinder 132 engages the motor mount 24. The cylinder is mounted to outwardly extending bosses 132 extending perpendicular to the page in FIG. 5 that engage openings in the motor mount 24, enabling the cylinder to pivot in the plane of the page toward and away from the motor. An adapter 134 has interior threads that engage exterior threads of the cylinder rod 136 and the cylinder tierod 138, joining the cylinder rod 136 and cylinder tierod 138 together. Exterior threads 137 of the cylinder tierod 138 engage the internal threaded holes 130 of the pivot member 128. A tierod 140 has external threads 141 that are received in the internal threaded hole 130 of the pivot members 124, 126. Therefore, members that can pivot about central axes perpendicular to the page in FIG. 5 are the tierod 140 at upper and lower pivot members 124, 126, cylinder 132 at the pivot member 132, tie rod 138 at the pivot member 128 and the linkage pivot pins 120*a*, 120*b* with respect to the retainer rings 104, 106. The arms are able to move relative to the pivotably joined rods 138, 140.

Referring to FIG. 3, in two-stroke operation, in moving the impeller from a lower position to the top of the up-stroke, for example, compressed air enters the pneumatic cylinder and raises the cylinder rod 136 into the cylinder 132, thereby raising the cylinder tierod 138. The distal portion 142 of the arms 100*a*, 100*b* is in a relatively fixed vertical position. Therefore, raising the cylinder tierod raises the proximal portion 144 of the arms 100*a*, 100*b*, which causes the pins 120*a*, 120*b* of the lever arm located within the retainer rings 104, 106 to apply an upward force against the collar 92 via the upper thrust component 114 of the upper bearing ring 108, effective to move the shaft 20 and thus the impeller 18, upward into the upper impeller chamber 14.

Referring to FIG. 4, in moving the impeller from an upper position to the bottom of the down-stroke, compressed air enters the pneumatic cylinder 132 and lowers the cylinder rod 136 from the cylinder, thereby lowering the cylinder tierod 138. Because the distal portion 142 of the arms is in a relatively fixed vertical position, this moves the proximal portion 144 of the arms downward, which causes the pins 120*a*, 120*b* of the lever arm located within the retainer rings 104, 106 to apply a downward force against the pump shaft coupling 94 via the lower thrust component 118 of the lower bearing ring 110, effective to move the shaft 20 and thus the impeller 18, downward into the lower impeller chamber 16. During the operation of the cylinder, pivoting of the various components takes place at the indicated bearing members. The pump shaft is centered inside the impeller chambers by the bearing sleeve 52 around the pump shaft 20 and corresponding base or inlet protector bearings and impeller bearings (e.g., inlet protector bearing ring 56, shaft bearing sleeve 52, lower base bearing ring 64 and impeller bearing ring 60. The operation of the cylinder and piston can be controlled by an operator, for example, who can direct the movement of the piston to the full up or down positions in this exemplary embodiment, using a suitable pneumatic control.

Another actuator that can be used to raise and lower the lever arm and thus, the shaft and impeller, is a screw type actuator known in the art (FIG. 5A). The actuator includes a motor 148 and a screw 150 that is rotated in a housing or support 152 by the motor. The lower end of the screw engages the threaded hole 130 of the pivot member 128. Rotation of the screw in one direction moves the arm upward while rotation of the screw in the opposite direction moves the arm downward in a well known manner of screw actuators.

Referring now to FIGS. 11-18 of the drawings, a second embodiment of the present invention features a pump 160 in which the impeller can be moved to straddle positions between impeller chambers. The pump comprises a base 162 including an upper transfer impeller chamber 164 and a lower circulation impeller chamber 166. Like reference numerals represent like parts throughout the several views of this disclosure and thus, the same components from the pump in FIGS. 1-10 need not be discussed again here. The impeller positioning device 99 described in FIGS. 1-10 is also used in the pumps shown in FIGS. 11-21 but is omitted to improve the clarity of the drawings. An impeller 168 is connected to a lower end portion of the pump shaft 20. Rotation of the drive shaft rotates the pump shaft and thus rotates the impeller in the impeller chambers.

Figure 12:
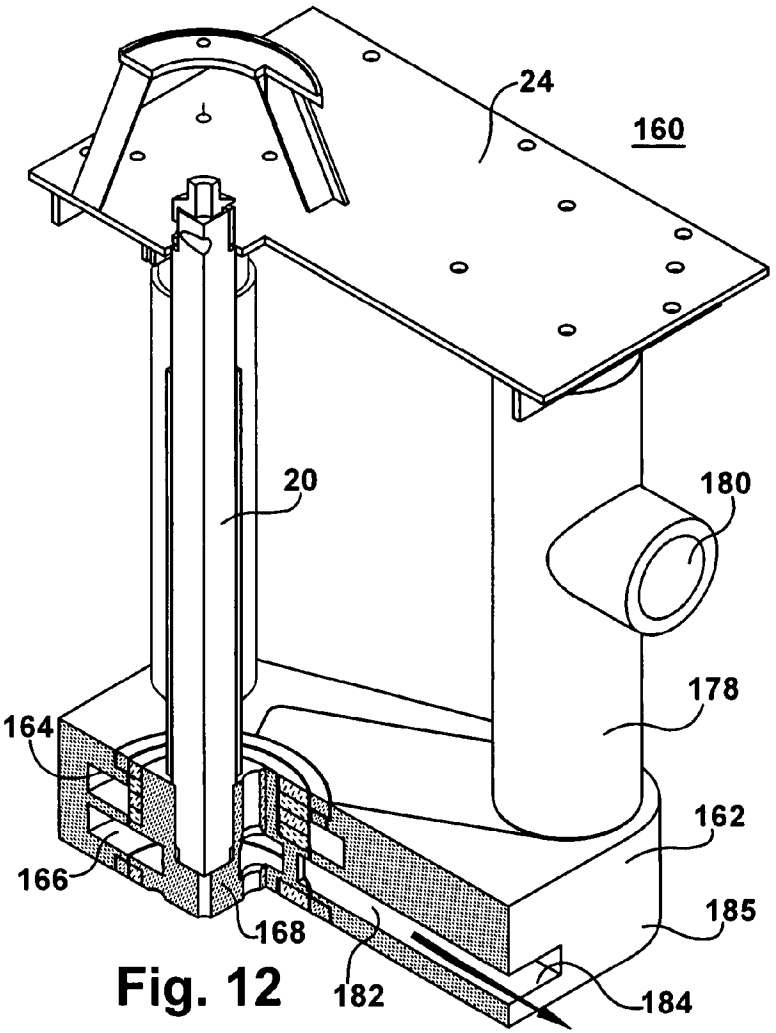
FIGS. 11 and 12 are cross-sectional perspective views of a second embodiment of a pump constructed in accordance with the present invention, wherein the impeller is located in a straddle position or in the lower impeller chamber, respectively.

In this exemplary design the base includes concentric upper and lower circular openings 170, 172 (FIG. 13) which can function as inlet openings and through which molten metal enters the base. The base includes two outlet passageways. A transfer discharge passageway 174 extends from the upper transfer impeller chamber to a socket 176. A lower end portion of an outlet conduit 178 is cemented into the socket while an upper end portion of the outlet conduit is fastened to the motor mount 24. As shown in FIG. 12, the outlet conduit includes an outlet opening 180 located below a surface of the molten metal, which performs the function of the pump disclosed in the Vortexer Application, which is incorporated by reference. A discharge passageway 182 extends from the lower circulation impeller chamber 166 to a discharge opening 184 formed in the exterior surface 185 of the base. The transfer and circulation impeller chambers both have walls that form volutes 186, 188, respectively, in this exemplary design (FIG. 14). The volutes enable the pump to pump molten metal more efficiently compared to pumps in which the impeller is located in a nonvolute impeller chamber.

The impeller 168 can be moved vertically along the rotational axis A to a full up stroke (FIG. 15) in which the impeller is positioned for full output from the upper impeller chamber, a full down stroke (FIGS. 12 and 16) in which the impeller is positioned for full output from the lower impeller chamber and in straddle positions between the full-up and full-down strokes (FIGS. 11, 13, 13A and 13B).

Any suitable impeller or impeller members may be used in this embodiment of the present invention including squirrel cage, vaned type and barrel type, single or dual intake, and with or without a baffle between impeller members. Examples of impellers that are suitable for use in the present invention are disclosed in U.S. Pat. No. 6,881,030, which is incorporated herein by reference in its entirety.

The particular design of the pump shown in FIGS. 11-18 advantageously employs the vaned, dual intake impeller with common outlet 168 (FIGS. 17 and 18) formed of refractory material, which includes a central hub portion 190 centered around the rotational axis A of the impeller. An upper end face 192 is located at an upper end of the impeller and extends transverse to the rotational axis. A lower end face 194 is disposed at an opposite, lower end of the impeller and extends transverse to the rotational axis. The impeller has a length L between the upper and lower end faces along the rotational axis. Vanes 196 extend outwardly from the hub portion 190 between the upper and lower end faces and cavities 198 are formed between the adjacent vanes 196 and upper and lower interior surfaces 200, 202 of the impeller extending transverse to the rotational axis. A plurality of upper inlet openings 204 are located in the upper end face 192 and a plurality of lower inlet openings 206 are located in the lower end face 194. A plurality of upper passages 208 extend from the upper inlet openings 204 to the cavities 198 and a plurality of lower passages 210 extend from the lower inlet openings 206 to the cavities 198.

A central shoulder 212 is approximately centrally located and is between the cavities 198 and the upper end face 192 along the rotational axis. A lower shoulder 214 is located between the cavities and the lower end face 194 along the rotational axis. A series of bearing rings 216*a-d* are cemented to the impeller in contact with an adjacent bearing ring 216 or the central shoulder 212. The series of bearing rings extends along the rotational axis for approximately at least ⅓ to ½ of the length of the impeller. The axially elongated stack of bearing rings on the impeller enables the impeller bearing rings to engage the upper base bearing ring when the impeller is positioned in the full up or full down positions as well as in any position therebetween. A bearing ring 218 is cemented onto the lower shoulder 214. The impellers shown in FIGS. 17, 18, 22 and 23 may be formed of graphite and include bearing rings having the compositions described in this disclosure.

Figure 22:
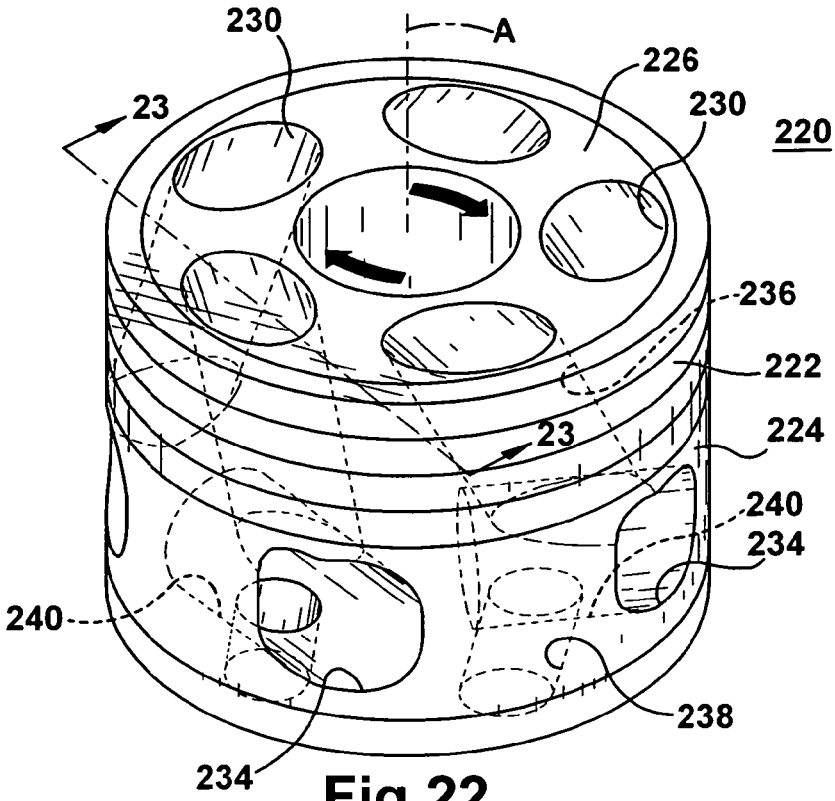
FIG. 22 is a perspective view of a barrel type impeller constructed in accordance with the present invention.
Figure 23:
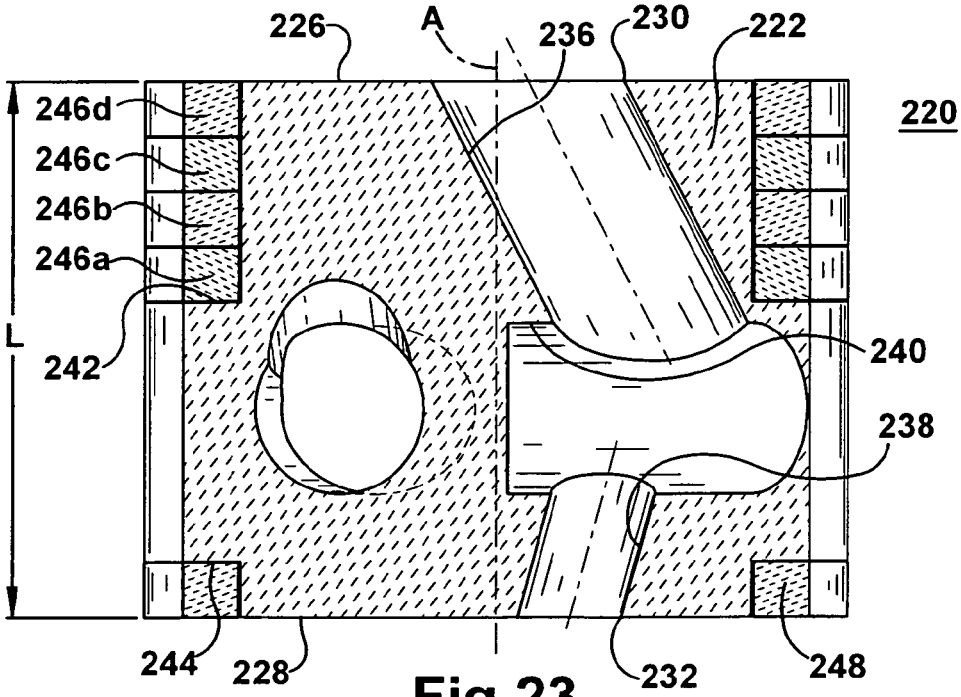
FIG. 23 is a vertical cross-sectional view of the impeller taken along the cutting plane designated by lines and arrows labeled 23-23 in FIG. 22.

Referring to FIGS. 22 and 23, a barrel impeller 220 formed of refractory material that is suitable for use in the present invention includes a cylindrical body 222 having a central rotational axis A and a side surface 224 extending around a periphery of the body. An upper end face 226 is located at an upper end of the body and a lower end face 228 is disposed at an opposite, lower end of the body, both of which extend transverse to the rotational axis. The impeller has a length L between the upper and lower end faces along the rotational axis. A plurality of upper inlet openings 230 are located in the upper end face 226 and a plurality of lower inlet openings 232 are located in the lower end face 228. A plurality of outlet openings 234 are located in the side surface 224. A plurality of upper passages 236 extend from the upper inlet openings 230 to the outlet openings 234. A plurality of lower passages 238 extend from the lower inlet openings 232 to the outlet openings 234. The upper and lower passages 236, 238 may extend at angles relative to the central axis into fluid communication with passageways 240 that lead to the outlet openings 234. In this particular design the passageways 240 extend generally horizontally.

A central shoulder 242 is approximately centrally located and is between the outlet openings 234 and the upper end face 226 along the rotational axis. A lower shoulder 244 is located between the outlet openings 234 and the lower end face 228 along the rotational axis. A series of bearing rings 246*a-d* are cemented to the impeller in contact with an adjacent bearing ring 246 or the central shoulder 242. The series of bearing rings extends along the rotational axis for at least ⅓ to ½ of the length of the impeller. The axially elongated stack of bearing rings on the impeller enables the impeller bearing rings to engage the upper base bearing ring when the impeller is positioned in the full up or full down positions as well as in any position therebetween. A lower bearing ring 248 is cemented onto the lower shoulder 244.

In the present invention the impeller is able to be vertically moved up or down to a selected position in the impeller chambers. The impeller may be positioned so as to discharge only into a single base discharge passageway (full output, e.g., transfer or circulation) and/or so as to discharge simultaneously into both discharge passageways (blended output). When rotated in a single impeller chamber at full output the impeller maximizes molten metal output into the discharge passageway corresponding to the impeller chamber in which the impeller rotates and minimizes molten metal output into the other discharge passageway corresponding to the impeller chamber in which it does not rotate. When rotated so as to simultaneously output molten metal into two discharge passageways, the relative amounts of molten metal discharged into each passageway can be controlled by vertically moving the impeller so as to expose a greater or lesser area of the impeller outlets to each passageway as desired.

The base includes upper and lower shoulders 250, 252 disposed around the upper and lower base inlet openings 170, 172. Upper and lower base bearing rings 254, 256 are cemented onto the upper and lower base shoulders.

In full output transfer mode (FIG. 15), in the full up stroke the shaft is moved to position the impeller in the selected upper transfer impeller chamber. This causes molten metal to be directed into the upper and lower base inlet openings 170, 172, into the inlet openings 204, 206 of the impeller, into the transfer impeller chamber 164, through the impeller passages and out of outlet openings or cavities 198 of the impeller (FIG. 10), through the transfer discharge passageway 174, and along the outlet conduit 178 to an intended discharge location. In the full-up stroke the amount of molten metal traveling into the transfer discharge passageway is at a maximum. The molten metal flow is shown by arrows in FIG. 15.

In full output circulation mode (FIGS. 12 and 16), in the full down stroke the shaft is moved downwardly along its rotational axis to move the impeller into the lower circulation impeller chamber 166. This causes molten metal to be directed into the upper and lower base inlet openings 170, 172, into the impeller inlet openings 204, 206, into the circulation impeller chamber 166, through the impeller passages and out of the impeller outlet openings or cavities 198, through the circulation discharge passageway 182, through the discharge opening 184 and to a discharge location just outside the base. In the full-down stroke the amount of molten metal traveling into the circulation discharge passageway is at a maximum. The molten metal may travel into an adapter conduit between the base and a scrap charging chamber as disclosed in the Vortexer Application. The molten metal flow is shown by arrows in FIG. 16.

Figure 11:
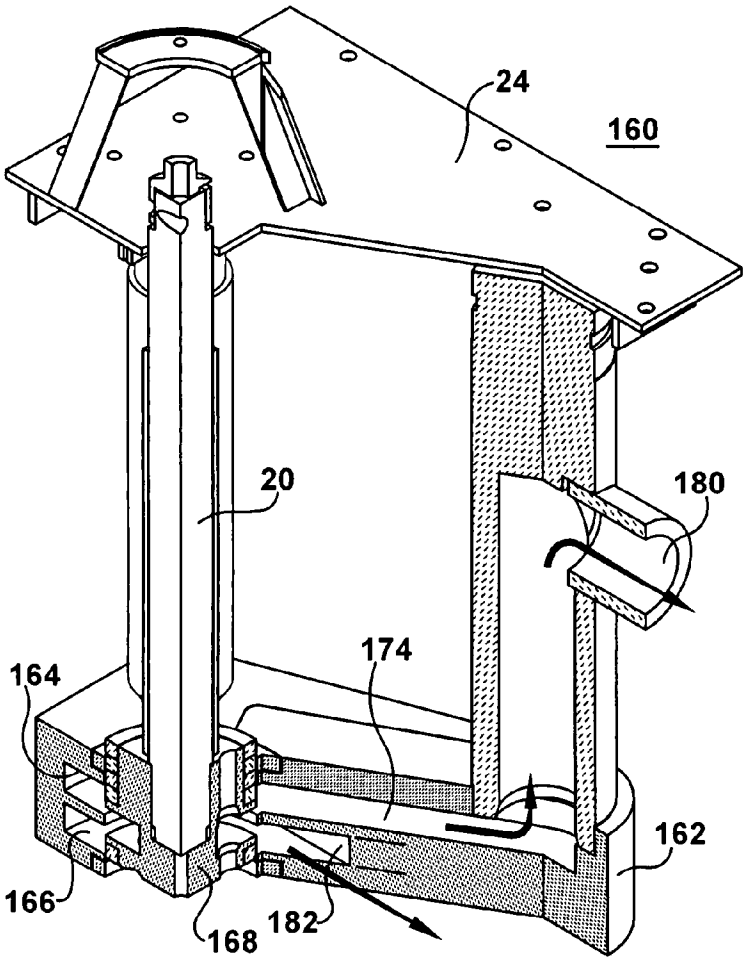
Figure 13:
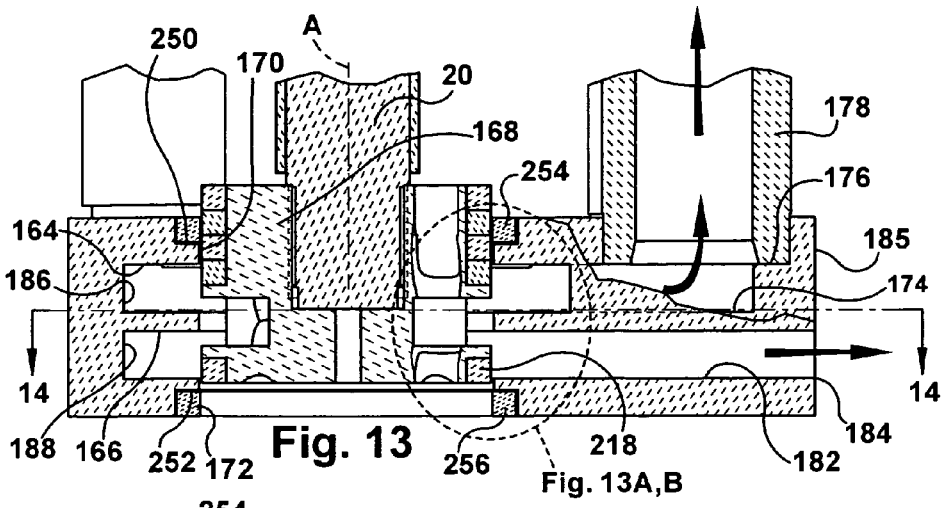
FIGS. 13, 15 and 16 are vertical cross-sectional views wherein the impeller is positioned in a straddle position in the upper impeller chamber and in the lower impeller chamber, respectively.
Figure 14:
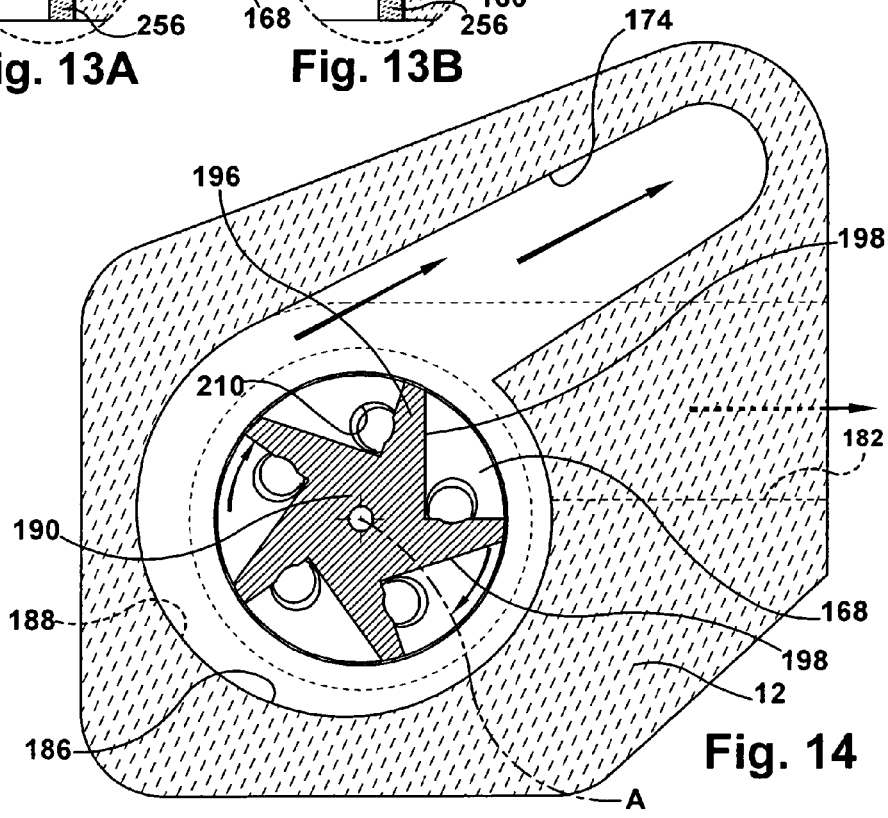
FIG. 14 is a cross-sectional view of the upper impeller chamber taken along the cutting plane designated by lines and arrows labeled 14-14 in FIG. 13.

In blended mode, the impeller is positioned so that the impeller outlets straddle adjacent base discharge passageways 174, 182, as shown in FIGS. 11 and 13, to produce a blend of transfer and circulation output from the pump. This causes molten metal to be directed into the upper and lower base inlet openings 170, 172, into the impeller upper and lower inlet openings 204, 206, into the upper and lower impeller chambers 164, 166, through the impeller passages and out the cavities 198 of the impeller. The molten metal output from the impeller travels into both the transfer discharge passageway 174 and the circulation discharge passageway 182. The molten metal flow is shown by arrows in FIG. 13.

Figure 15:
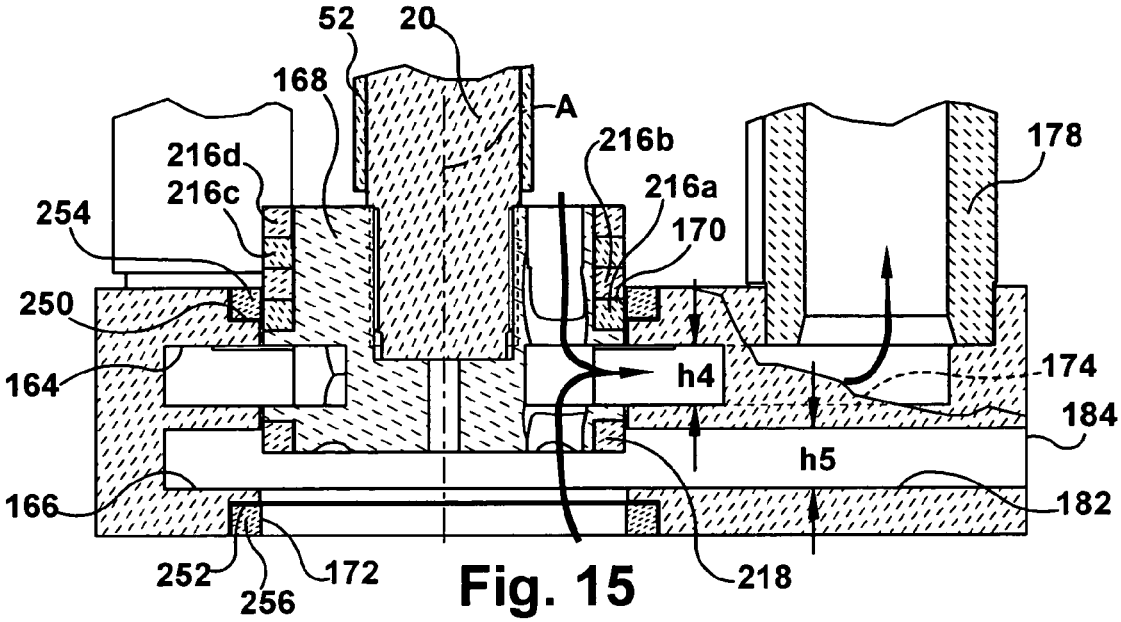
Figure 16:
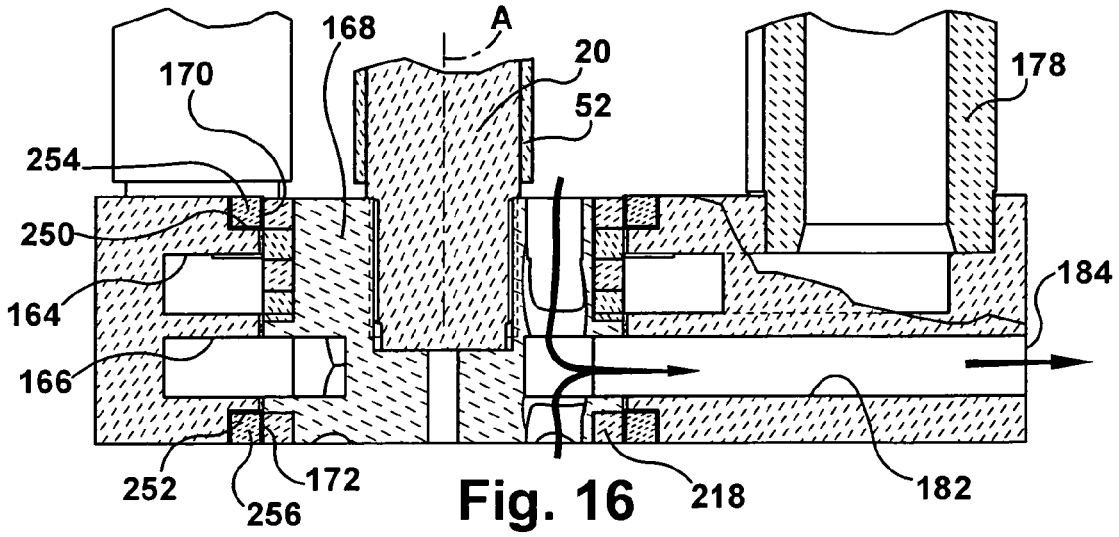
Figure 18:
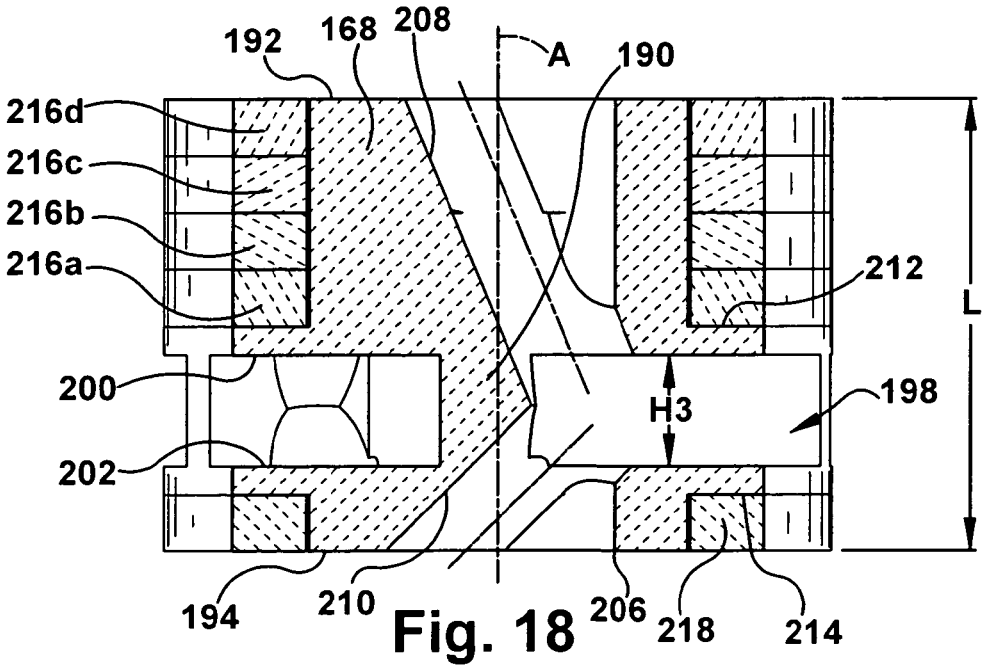
FIG. 18 is a vertical cross-sectional view of the impeller taken along the cutting plane designated by lines and arrows labeled 18-18 in FIG. 17.

The impeller outlet openings can have a height h3 that is approximately the same height h4, h5 as the transfer and circulation discharge passageways 174, 182 (see FIGS. 15 and 18). When the impeller is positioned in the transfer impeller chamber or in the circulation impeller chamber (full output), its outlet openings are aligned with and approximately the same height as the outlet passageways of the transfer or circulation chambers. Thus, rotation of the impeller directs most or all of the molten metal into the outlet passageway with which its outlets are aligned and minimizes molten metal flow from the other outlet passageway with which its outlets are not aligned.

It should be apparent to those of ordinary skill in the art that variations can be made to the impeller and pump design depending on the intended functionality of the pump. For example, there can be a greater vertical distance between impeller chambers along the rotational axis and an impeller can be used in which the impeller outlets have a height that is greater than a height of the discharge passageway. This impeller will still permit flow mostly through the discharge passageway with which its outlets are aligned, because the impeller outlets that extend outside that impeller chamber will not extend into alignment with the adjacent discharge passageway. When the impeller is disposed in the upper impeller chamber in alignment with the transfer discharge passageway, these outside impeller outlets will be above the upper discharge passageway. When the impeller is disposed in the lower impeller chamber in which its outlets are in alignment with the circulation discharge passageway, the outside impeller outlets will be located at the wall of the base extending between impeller chambers. However, when the impeller straddles impeller chambers, it may now have a greater area of outlets exposed to both discharge passageways. In all pump designs of the present invention, the impeller and the separating wall between the impeller chambers may be designed to include corresponding bearing rings.

The particular pump of FIGS. 11-18 does not utilize an inlet protector such as disclosed in U.S. Pat. No. 6,533,535.

The riser may include a bleed hole to relieve a possible rise in molten metal inside the riser such as when the impeller is rotated in the lower circulation impeller chamber.

The pump and components shown in FIGS. 11-18, 22 and 23 are adapted for use in the scrap submergence application as disclosed in the Vortexer Application. The pump used in connection with a vortexer apparatus as disclosed in the Vortexer Application has an outlet conduit 178 in which its passageway is completely submerged in molten metal along its length from the base to the outlet 180 and to the scrap charging chamber. The die casting pump shown in FIGS. 1-10 has a conventional riser enabling molten metal to be transferred to a remote location such as to a ladle outside the molten metal bath. However, it will be appreciated by one of ordinary skill in the art reading this disclosure, that the pump of the FIGS. 1-10 can be used in the scrap submergence application and the pump shown in FIGS. 11-18 can be used for die casting, by modifying the outlet conduits to be suitable for the particular application. That is, the pump shown in FIGS. 1-10 would have an outlet conduit that terminates at a lower level beneath the molten metal surface if used in connection with a vortexer vessel whereas the pump shown in FIGS. 11-18 would include a riser that extends to the motor mount and be joined to a conduit extending to a remote transfer location, if used in connection with die casting. Another difference of these pumps resides in the design of the impeller and pump inlet. The pump of FIGS. 11-18 has an unprotected upper base inlet and bearings on the base and impeller, while the pump of FIGS. 1-10 has a protected upper base inlet and bearings on the inlet protector, shaft and impeller. The feature of using a protected pump inlet or not and how to position bearing rings on the inlet protector or base are modifications that can be made to either of these pumps. The present invention should not be limited to the particular examples of pumps shown in the drawings as the foregoing and other variations can be made by those of ordinary skill reading this disclosure, without departing from the spirit and scope of the invention.

Figure 17:
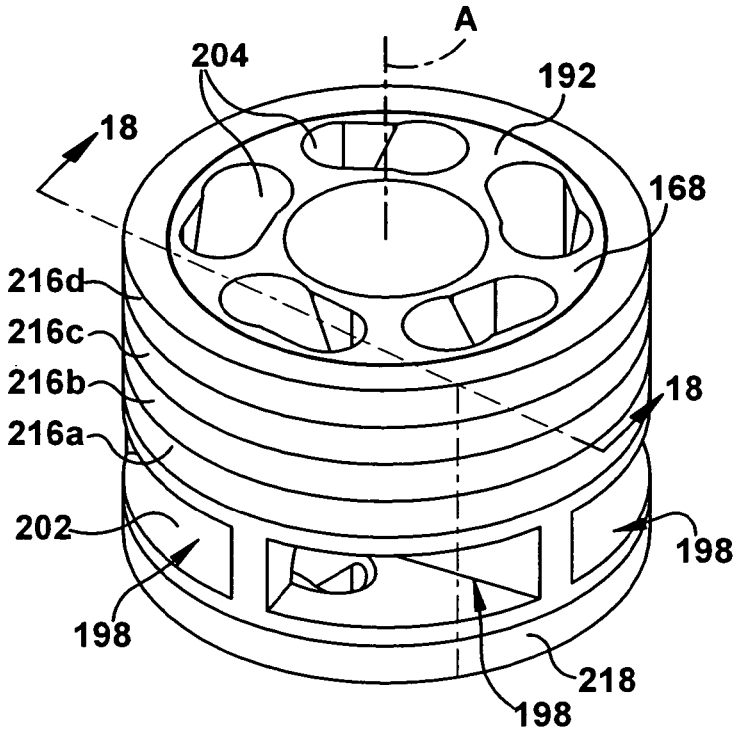
FIG. 17 is a perspective view of a vaned impeller constructed in accordance with the present invention.

The present invention of the second embodiment employs the impeller positioning device 99 described above in connection with the pump shown in FIGS. 1-10, even though the device is used for two stroke movement in the pump of the first embodiment and is used to move the shaft and impeller to multiple positions in this embodiment. In the second embodiment the device 99 is used to move the impeller to three or more positions: full output from the transfer impeller chamber (FIG. 15), full output from the circulation impeller chamber (FIG. 16) and straddling the impeller and circulation discharge passageways (FIG. 13). If a pump having blended flow is desired, the impeller shown in FIG. 17 or 22 is advantageously used so that the upper bearing rings of the impeller are vertically aligned with the upper bearing ring of the base, regardless of the vertical position of the impeller.

Figure 13A:
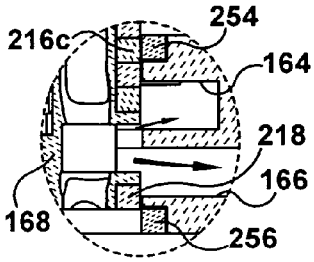
FIGS. 13A and 13B are enlarged views showing different straddle positions of the impeller.
Figure 13B:
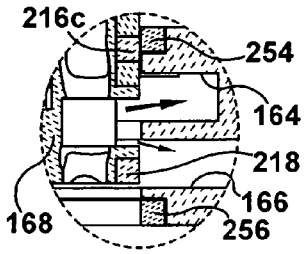

The infinite impeller positioning device may include a programmable logic controller (PLC) 260 that is programmed to move the impeller to any of a plurality of positions. For example, the PLC may be programmed to move the impeller to one of five commonly used positions: 1) full output from the transfer chamber (FIG. 15); 2) full output from the circulation chamber (FIG. 16); 3) straddling both discharge passageways for equal output into each (FIG. 13); 4) straddling the discharge passageways with a majority of the area of the impeller outlets discharging into the transfer discharge passageway (FIG. 13B), and 5) straddling the discharge passageways with a majority of the area of the impeller outlets discharging into the circulation discharge passageway (FIG. 13A). This enables operation of the pump in die casting or scrap submerging applications, for example, to circulate-only or to transfer-only at the maximum rate or higher rate that pumps in these applications currently achieve. In addition, the pump can simultaneously transfer and circulate molten metal, wherein the discharge is carried out: at equal transfer and circulation flow rates; at a higher transfer flow rate and lower circulation flow rate; or at a lower transfer flow rate and higher circulation flow rate. Those of ordinary skill in the art will appreciate in view of this disclosure that the infinite shaft moving apparatus enables a wide variety of possible flow rates and different modes of pump functionality within the scope of the present invention. Many other positions of the impeller are possible in accordance with the present invention.

One suitable infinite control mechanism is a servo-pneumatic type actuator and control. One example of such an actuator is referred to as a Bimba™ Position Feedback Cylinder, Model PFC-506-BFP, described in the brochure "Bimba Position Feedback Cylinders," pp. 7.56, which is incorporated herein by reference in its entirety. One example of such a control is Bimba™ Pneumatic Control System Model PCS, Model PCS-5-Q, which is described in the brochure "Bimba Position Control System" pp. 7.25, 7.26, 7.30, which is incorporated herein by reference in its entirety.

Another suitable infinite control mechanism is a servo-electronic screw drive type actuator and control. One example of such an actuator is referred to as Electrak 205 by Thomson™, Model Nos. ALP12-0585-08D or ALP22-0585-08D. One example of such a control by Thomson™ has Model Nos. MCS-2051 or MCS-2052. These actuators and controls are described in the Elektrak 205 brochure by Thomson, pp. D-26, D-27, D-53 and D-54, which is incorporated herein by reference in its entirety. Position feedback cylinders suitable for infinite control of the impeller in the impeller chambers is described in Schneider, R., "Working with Position-Feedback Cylinder Technology," printed May 24, 2005 (http://www.bimba.com/techctr/schneidr/htm), reprinted from Hydraulics & Pneumatics, September 1996, which is incorporated herein by reference in its entirety.

Both the servo-pneumatic type actuator and control system and the servo-electronic screw drive type actuator and control system could include a PLC, enabling the pump operator to program the desired impeller position depending on process parameters.

A third embodiment of the present invention features a pump 270 including a base 272 having three impeller chambers. The impeller chambers in this pump can be any combination and arrangement of transfer and circulation impeller chambers. In one exemplary design shown in FIGS. 19-21, the base includes an upper transfer impeller chamber 274, a middle circulation impeller chamber 276, and a lower transfer impeller chamber 278. The base includes an upper transfer discharge passageway 280 extending from the upper transfer impeller chamber to a first transfer location, a middle circulation discharge passageway 282 extending from the middle circulation impeller chamber to a discharge opening 283 in the exterior surface of the base and a lower discharge passageway 284 extending from the lower transfer impeller chamber to a second transfer location.

A socket 286 is disposed in the base in fluid communication with the upper discharge passageway 280. A lower portion of a first outlet conduit 288 is cemented into the socket and extends upwardly therefrom toward the first transfer location. A socket 290 is disposed in the base in fluid communication with the lower, second transfer discharge passageway 284. A lower portion of a second outlet conduit 292 is cemented into the socket 290 and extends upwardly therefrom toward the second transfer location.

The base includes upper and lower shoulders 294, 296 disposed around the upper and lower base inlet openings 170, 172. Upper and lower base bearing rings 298, 300 are cemented onto the upper and lower base shoulders.

Figure 19:
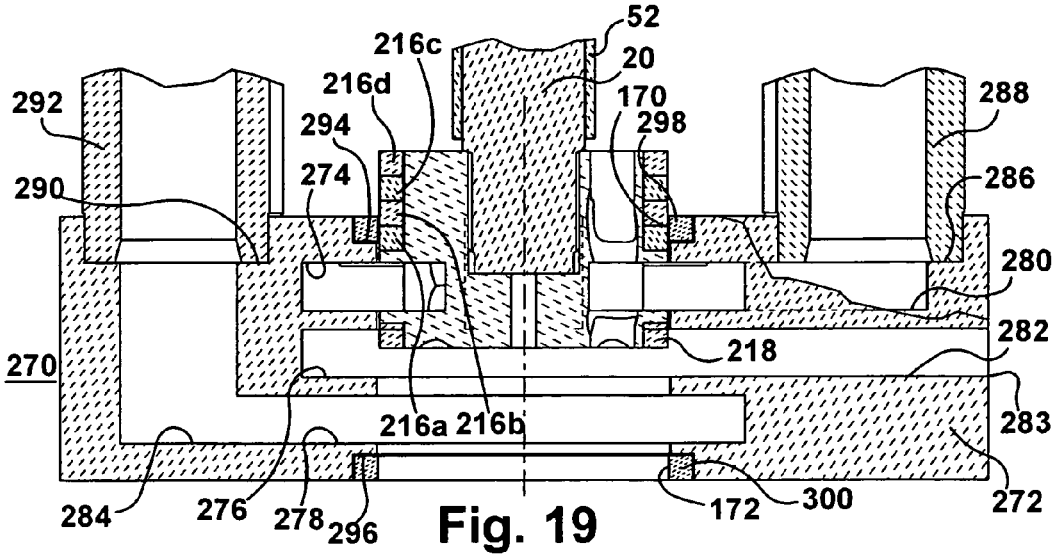
FIGS. 19-21 are enlarged vertical cross-sectional views of another pump constructed in accordance with the present invention having upper and lower transfer impeller chambers and an intermediate circulation impeller chamber, wherein the impeller is positioned to output from the upper impeller chamber, the intermediate impeller chamber and the lower impeller chamber, respectively.
Figure 20:
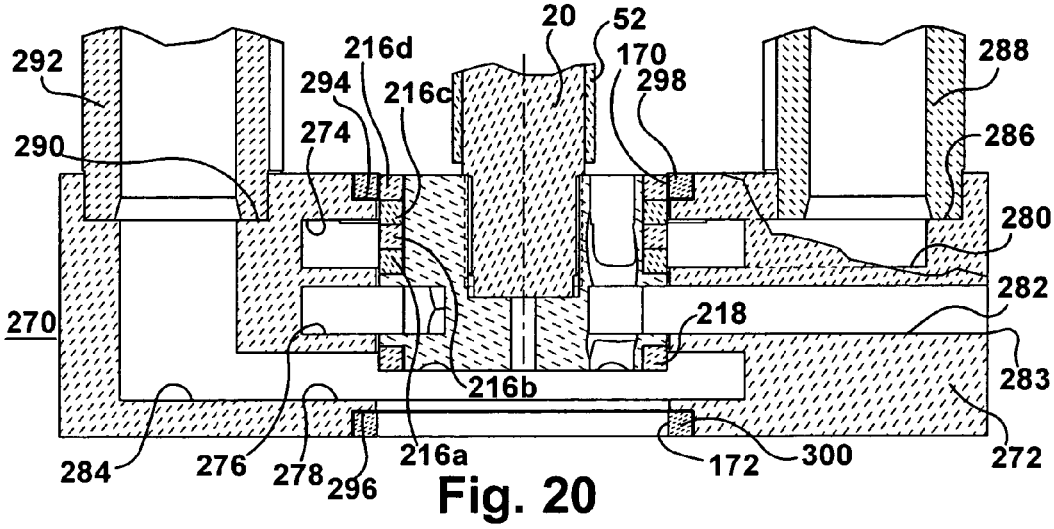
Figure 21:
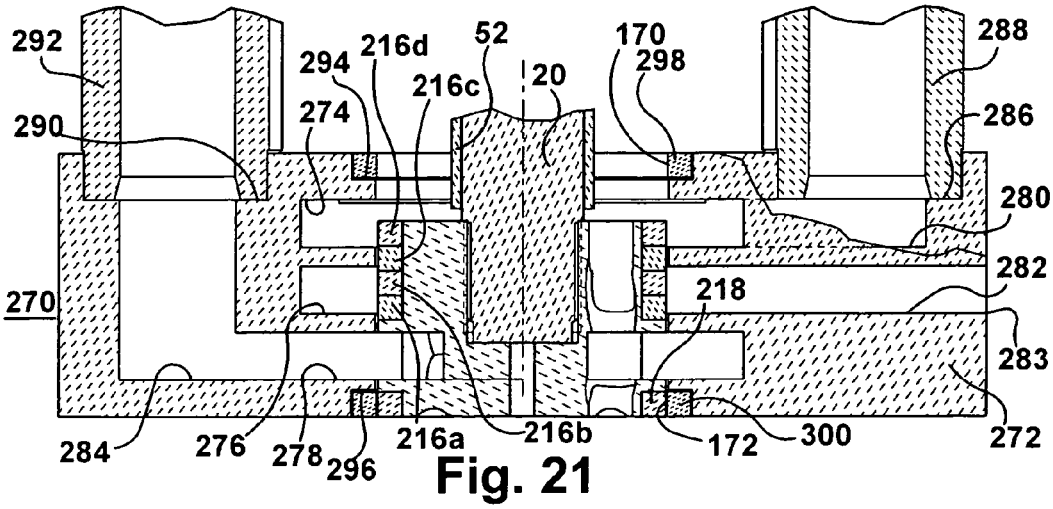

When it is desired to transfer molten metal to the first transfer location the pump is operated in a full up stroke and the impeller is rotated in the upper, first transfer impeller chamber 274 (full first transfer output; FIG. 19). When it is desired to transfer the molten metal to a second transfer location the pump is operated in a full down stroke and the impeller is rotated in the lower, second transfer impeller chamber 278 (full second transfer output; FIG. 21). When circulation is desired, the impeller is rotated in the middle circulation impeller chamber 276 (full circulation output; FIG. 20).

The extreme versatility of the present invention is evident in this pump design. If it is desired to achieve simultaneous circulation and transfer to the first location, the impeller can be positioned to straddle the upper and middle discharge passageways (e.g., by positioning the impeller like in FIG. 13). If it is desired to achieve simultaneous circulation and transfer to the second location, the impeller can be positioned to straddle the middle and lower discharge passageways (e.g., by positioning the impeller like in FIG. 13). The infinite adjustment capability of the present invention enables further variations as would be apparent to one of ordinary skill in the art reading this disclosure. For example, the pump could be operated in an upper straddle position that outputs a higher first transfer flow rate than circulation flow rate and at a lower straddle position that outputs a higher second transfer flow rate than circulation flow rate (see FIGS. 13A, 13B). The pump 270 may include an impeller having a longer length L and series of bearing rings 216 so that one of the rings 216 is in alignment with the upper base bearing ring 298 when the impeller is in the lower position shown in FIG. 21.

One example of a three chamber pump according to the invention is a combination scrap charging/die casting pump. The first transfer discharge location (e.g., via outlet conduit 288) is the scrap charging well while the second transfer location (e.g., via outlet conduit 292) is the ladle. This pump can circulate molten metal at the same time it transfers molten metal to the ladle or to a scrap charging well. In addition, it can transfer molten metal to the ladle only or to the scrap charging vessel only.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. A method of selectively pumping molten metal comprising the steps of:

positioning an impeller mounted to a pump shaft in a first impeller chamber of at least two impeller chambers formed in a base of a pump, said base including a base inlet opening, a first base outlet opening extending from said first impeller chamber and a second base outlet opening extending from a second said impeller chamber;

rotating said pump shaft so as to rotate said impeller member in said first impeller chamber effective to draw molten metal into said base through said base inlet opening and out of the base through said first base outlet opening;

moving said pump shaft to position said impeller in said second impeller chamber; and rotating said pump shaft so as to rotate said impeller member in said second impeller chamber effective to draw molten metal into said base through said base inlet opening and out of the base through said second base outlet opening.

2. The method of claim 1 wherein said first base outlet opening comprises a first outlet passageway extending from said first impeller chamber toward an exterior surface of said base, an outlet conduit being fastened to said base in fluid communication with said first outlet passageway and extending to a molten metal transfer location; and wherein rotating said impeller in said first impeller chamber directs molten metal out of the base and through said outlet conduit to said transfer location.

3. The method of claim 2 wherein said second base outlet opening comprises a second outlet passageway extending from said second impeller chamber to an outlet opening formed in an exterior surface of said base;

wherein rotating said impeller in said second impeller chamber directs molten metal out of the base through said outlet opening.

4. The method of claim 3, comprising selecting whether to operate said pump in a transfer mode or a circulation mode and vertically moving said shaft according to said selected mode effective to position said impeller in one of said first impeller chamber and said second impeller chamber, respectively, rotating said impeller in said first impeller chamber, causing said molten metal to travel out said first discharge passageway along said transfer conduit to said transfer location, according to said selected transfer mode, and rotating said impeller in said second impeller chamber, causing said molten metal to travel out said second outlet passageway through said base outlet opening to an exterior of said base, according to said selected circulation mode.

5. The method of claim 3 comprising selecting whether to operate said pump in a transfer mode, a circulation mode or a blended mode and vertically moving said shaft according to said selected mode effective to position said impeller in said first impeller chamber, said second impeller chamber, or to straddle said first impeller chamber and said second impeller chamber, respectively;

rotating said impeller in said first impeller chamber, causing said molten metal to travel out said first outlet passageway along said outlet conduit to said transfer location, according to said selected transfer mode;

rotating said impeller in said second impeller chamber, causing said molten metal to travel out said second outlet passageway through said base outlet opening to an exterior of said base, according to said selected circulation mode; and rotating said impeller in said first impeller chamber and said second impeller chamber, causing said molten metal to travel simultaneously: a) out said first outlet passageway through said outlet conduit to said transfer location, and b) along said second outlet passageway out said base outlet opening to an exterior of said base, according to said selected blended mode.

6. The method of claim 5 comprising moving said impeller in said blended mode to at least two positions effective to change the relative amounts of flow into said first outlet passageway and said second outlet passageway.

7. The method of claim 5 comprising moving said impeller in said blended mode to a plurality of positions effective to achieve molten metal flow rates including: a) a maximum flow rate into said first outlet passageway and a minimum flow rate into said second outlet passageway, b) a maximum flow rate into said second outlet passageway and a minimum flow rate into said first outlet passageway and c) a plurality of flow rates between a) and b).

* * * * *